US010654286B2

(12) United States Patent
Reyero et al.

(10) Patent No.: US 10,654,286 B2
(45) Date of Patent: May 19, 2020

(54) CONFIGURABLE ERROR HIDING

(71) Applicant: Xaar Technology Limited, Cambridge (GB)

(72) Inventors: Juan Reyero, Cambridge (GB); Stephen Mark Jeapes, Cambridge (GB); Jesus Garcia, Ely (GB)

(73) Assignee: XAAR TECHNOLOGY LIMITED, Cambridge (GB)

( * ) Notice: Subject to any disclaimer, the term of this patent is extended or adjusted under 35 U.S.C. 154(b) by 4 days.

(21) Appl. No.: 16/064,074

(22) PCT Filed: Dec. 14, 2016

(86) PCT No.: PCT/GB2016/053933
§ 371 (c)(1),
(2) Date: Jun. 20, 2018

(87) PCT Pub. No.: WO2017/109461
PCT Pub. Date: Jun. 29, 2017

(65) Prior Publication Data

US 2019/0001702 A1 Jan. 3, 2019

(30) Foreign Application Priority Data

Dec. 23, 2015 (GB) ..... 1522806.7

(51) Int. Cl.
*B41J 2/21* (2006.01)
*B41J 2/205* (2006.01)
(Continued)

(52) U.S. Cl.
CPC ..... *B41J 2/2139* (2013.01); *B41J 2/0451* (2013.01); *B41J 2/205* (2013.01); *B41J 2/2052* (2013.01);
(Continued)

(58) Field of Classification Search
CPC ..... B41J 2/2139; B41J 2/0451; B41J 2/2052; B41J 2/2054
See application file for complete search history.

(56) References Cited

U.S. PATENT DOCUMENTS 6,406,114 B1 6/2002 Shioya
6,520,623 B2 * 2/2003 Miyake ..... B41J 2/2139 347/40
(Continued)

FOREIGN PATENT DOCUMENTS

| | | |
|---|---|---|
| AU | 767075 | 10/2003 |
| EP | 0863004 | 9/1998 |
| EP | 2631076 | 8/2013 |

OTHER PUBLICATIONS

International Search Report and Written Opinion dated Apr. 7, 2017 for PCT/GB16/053933.
(Continued)

*Primary Examiner* — Thinh H Nguyen
(74) *Attorney, Agent, or Firm* — Finnegan, Henderson, Farabow, Garrett & Dunner LLP

(57) ABSTRACT

Broadly speaking, embodiments of the present technique provide apparatus and methods to print an image using masking techniques that control the operation of a droplet deposition head having at least one faulty nozzle. More specifically, an image is analysed to determine a pixel colour density for each pixel of the image. A masking technique is provided which may distribute the droplets (or sub-droplets) that a faulty nozzle is assigned to print among one or more neighbouring, functioning nozzles.

19 Claims, 8 Drawing Sheets

(51) Int. Cl.
*B41J 2/045* (2006.01)
*B41J 2/165* (2006.01)

(52) U.S. Cl.
CPC ..... *B41J 2/2054* (2013.01); *B41J 2/165* (2013.01); *B41J 2/16579* (2013.01)

(56) References Cited

U.S. PATENT DOCUMENTS

| | | | | |
|---|---|---|---|---|
| 6,778,299 | B2 | 8/2004 | Lin et al. | |
| 7,261,388 | B2 | 8/2007 | Vega et al. | |
| 7,387,361 | B1 | 6/2008 | Rueby et al. | |
| 7,690,744 | B2 * | 4/2010 | Nakanishi ..... | B41J 2/2139 347/12 |
| 2008/0273060 | A1 | 11/2008 | Kuwahara et al. | |
| 2009/0015615 | A1 | 1/2009 | Miyamoto | |
| 2009/0033694 | A1 | 2/2009 | Shi et al. | |
| 2009/0315939 | A1 | 12/2009 | Mantell et al. | |
| 2015/0202862 | A1 | 7/2015 | Tamai | |

OTHER PUBLICATIONS

Examination Report dated Jan. 24, 2018 for GB1522806.7.
Examination Report dated Aug. 18, 2017 for GB1522806.7.
Examination Report dated Mar. 20, 2017 for GB1522806.7.
Examination Report dated Dec. 19, 2016 for GB1522806.7.
Examination Report dated Jun. 24, 2016 for GB1522806.7.

* cited by examiner

| | 0 | 1 | 2 | 3 | 4 | 5 | M |
|---|---|---|---|---|---|---|---|
| 0 | 0 | 0 | 0 | 0 | 0 | 0 | |
| 1 | 0 | 1 | 0 | 1 | 1 | 0 | |
| 2 | 0 | 2 | 1 | 1 | 2 | 0 | |
| 3 | 0 | 3 | 1 | 2 | 1 | 2 | |
| G | | | | | | | |

172

174

170

| | 0 | 1 | 2 | 3 | 4 | 5 | M |
|---|---|---|---|---|---|---|---|
| 0 | 0 | 0 | 0 | 0 | 0 | 0 | |
| 1 | 0 | 1 | 0 | 1 | 1 | 0 | |
| 2 | 0 | 2 | 1 | 1 | 2 | 1 | |
| 3 | 0 | 3 | 1 | 2 | 2 | 2 | |
| G | | | | | | | |

172

174

176

FIGURE 8

CONFIGURABLE ERROR HIDING

CROSS REFERENCE TO RELATED APPLICATIONS

This application claims the benefit of International Application No. PCT/GB16/053933, filed Dec. 14, 2016, and GB Patent Application No. GB 15 22806.7, filed Dec. 23, 2015.

The present techniques generally relate to methods, apparatus and systems for printing an image, and in particular to an apparatus for printing an image using a masking technique to compensate for a faulty nozzle.

Generally speaking, a droplet deposition apparatus, such as an inkjet printer, print dots by ejecting small droplets of fluid (e.g. ink) onto receiving media. Such a droplet deposition apparatus typically comprises at least one droplet deposition head having a nozzle array. The nozzle array comprises multiple nozzles, where each nozzle is configured to eject droplets of fluid (e.g. ink) in response to a command signal received from control circuitry, to reproduce an image onto a receiving medium. Typically, a droplet deposition apparatus may divide an image (or a swathe of an image) into several sub-images. (However, if the image is as wide as the droplet deposition head, this division may not be performed). Each sub-image may be printed either by a droplet deposition head which passes over the receiving medium multiple times to reproduce each sub-image on the receiving medium. Alternatively, each sub-image may be printed by multiple droplet deposition heads located in different positions with respect to the receiving medium, where each droplet deposition head may be responsible for printing a particular sub-image. In this latter case, each droplet deposition head may remain in a fixed position, or may pass over the receiving medium multiple times.

The image to be printed is usually rasterised or divided into multiple pixels, each pixel having a colour density. Each pixel is allocated to a particular nozzle, such that the allocated nozzle is used to deposit the fluid required to achieve the colour density for the pixel on the receiving medium. When multi-pass printing is used, each droplet deposition head uses a 'multi-pass print mask' (also known as a 'print mask') to determine which nozzles of the nozzle array are to eject droplets during each pass. For example, in a four-pass printing mode, each pixel location on the receiving medium will be passed over four times by a particular nozzle that is responsible for depositing fluid to form that pixel. A print mask may be used to ensure that a pixel location does not receive more or less than the required amount of fluid.

Droplet deposition heads may, due to, for example, manufacturing errors, manufacturing tolerances or process variations, have missing nozzles, or may have nozzles which are not functioning correctly. If the number of missing and/or incorrectly functioning nozzles is below a particular threshold, the printhead may be deemed functional and may be incorporated into a droplet deposition apparatus. However, incorrectly functioning or non-existent nozzles may cause defects in the printed image which reduces the overall quality of the image.

There is therefore, a need for an improved technique to compensate for missing or incorrectly functioning nozzles of a droplet deposition head.

Aspects of the present techniques are set out in the appended claims.

The techniques are diagrammatically illustrated, by way of example, in the accompanying drawings, in which:

FIG. 8 shows example lookup tables for a masking technique.

Figure 1:
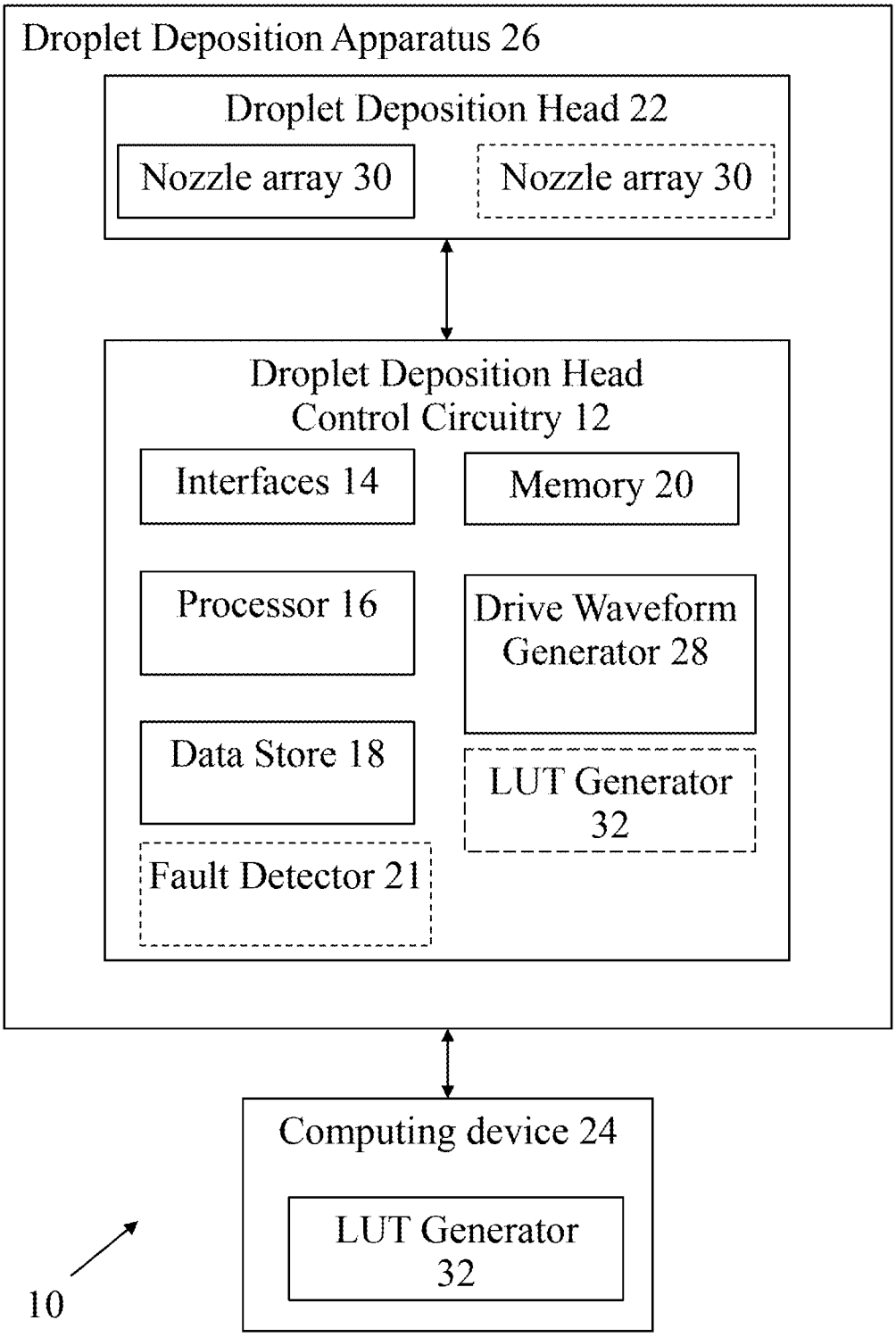
FIG. 1 shows a block diagram of a system to perform droplet deposition using a masking technique.

Broadly speaking, embodiments of the present technique provide apparatus and methods to print an image using masking techniques that control the operation of a droplet deposition head having at least one faulty nozzle. More specifically, an image is analysed to determine a pixel colour density for each pixel of the image. A masking technique is provided which may distribute the droplets (or sub-droplets) that a faulty nozzle is assigned to print among one or more neighbouring, functioning nozzles. An advantage of this masking technique is that it may optimise printing for droplet deposition heads that are capable of depositing droplets of varying sizes, such that the printing process is more efficient. A further advantage is that the masking technique enables different pixel colour densities to be provided across the image. A yet further advantage is that the masking technique is configurable to suit a particular droplet deposition head having particular characteristics.

The masking technique may involve analysing a processed image to determine a pixel colour density for each pixel of the processed image. The processed image may be, for example, an image to which one or more image data transformations (such as colour correction, colour separation, linearization, half-toning, etc.) have been applied. The processing/image transformations may be performed by circuitry, a processor or a computing device which is located remote to the circuitry/processor which implements the masking technique. This is advantageous because the amount of high spatial resolution processing performed by the circuitry/processor which implements the masking technique is reduced, and may simplify the masking technique itself. This is explained in more detail below.

According to a first aspect of the present technique there is provided an apparatus (droplet deposition apparatus) comprising: at least one droplet deposition head having a plurality of nozzles arranged in at least one row, the droplet deposition head configured to print an image; an interface for receiving an image to be printed, the image comprising a plurality of pixels; and at least one processor configured to: receive data indicating that a nozzle in a row is faulty; identify each pixel of the image that is assigned to be printed by the faulty nozzle; determine a pixel colour density for each identified pixel; determine a total number of sub-droplets required to provide the determined pixel colour density for each identified pixel; determine the maximum number of sub-droplets $SD_{max}$ ejectable by at least one neighbouring nozzle located in the vicinity of the faulty nozzle; select, using a lookup table, a mask value for the neighbouring nozzle, each mask value specifying zero or more sub-droplets to be printed for each identified pixel by the neighbouring nozzle instead of the faulty nozzle, wherein the mask value for each identified pixel is less than or equal to the maximum number of sub-droplets $SD_{max}$ of the neighbouring nozzle; generate a mask for the image comprising the selected mask values for the neighbouring nozzle; and operate the droplet deposition head to eject zero or more sub-droplets from the neighbouring nozzle according to the generated mask, such that the determined pixel colour density for each identified pixel assigned to the faulty nozzle is provided by the at least one neighbouring nozzle.

According to a second aspect of the present technique, there is provided a method for printing an image using a droplet deposition apparatus comprising at least one droplet deposition head having a plurality of nozzles arranged in at least one row, the method comprising: receiving an image to be printed, the image comprising a plurality of pixels; receiving data indicating that a nozzle in a row is faulty; identifying each pixel of the image that is assigned to be printed by the faulty nozzle; determining a pixel colour density for each identified pixel; determining a total number of sub-droplets required to provide the determined pixel colour density for each identified pixel; determining the maximum number of sub-droplets $SD_{max}$ ejectable by at least one neighbouring nozzle located in the vicinity of the faulty nozzle; selecting, using a lookup table, a mask value for the neighbouring nozzle, each mask value specifying zero or more sub-droplets to be printed for each identified pixel by the neighbouring nozzle instead of the faulty nozzle, wherein the mask value for each identified pixel is less than or equal to the maximum number of sub-droplets $SD_{max}$ of the neighbouring nozzle; generating a mask for the image comprising the selected mask values for the neighbouring nozzle; and operating the droplet deposition head to eject zero or more sub-droplets from the neighbouring nozzle according to the generated mask, such that the determined pixel colour density for each identified pixel assigned to the faulty nozzle is provided by the at least one neighbouring nozzle.

According to a third aspect of the present technique, there is provided a method for printing an image, the method comprising: receiving an image to be printed, the image comprising a plurality of pixels; receiving data indicating that a nozzle in a row of nozzles within a droplet deposition head is faulty; identifying each pixel of the image that is assigned to be printed by the faulty nozzle; determining a pixel colour density for each identified pixel; determining a total number of sub-droplets required to provide the determined pixel colour density for each identified pixel; determining the maximum number of sub-droplets $SD_{max}$ ejectable by at least one neighbouring nozzle located in the vicinity of the faulty nozzle; selecting, using a lookup table, a mask value for the neighbouring nozzle, each mask value specifying zero or more sub-droplets to be printed for each identified pixel by the neighbouring nozzle instead of the faulty nozzle, wherein the mask value for each identified pixel is less than or equal to the maximum number of sub-droplets $SD_{max}$ of the neighbouring nozzle; and generating a mask for the image comprising the selected mask values for the neighbouring nozzle.

According to a fourth aspect of the present technique, there is provided circuitry comprising: an interface for: receiving an image comprising a plurality of pixels, and receiving data indicating that a nozzle in a row of nozzles within a droplet deposition head is faulty; wherein the circuitry: identifies each pixel of the received image that is assigned to be printed by the faulty nozzle; determines a pixel colour density for each identified pixel; determines a total number of sub-droplets required to provide the determined pixel colour density for each identified pixel; determines the maximum number of sub-droplets $SD_{max}$ ejectable by at least one neighbouring nozzle located in the vicinity of the faulty nozzle; selects, using a lookup table, a mask value for the neighbouring nozzle, each mask value specifying zero or more sub-droplets to be printed for each identified pixel by the neighbouring nozzle instead of the faulty nozzle, wherein the mask value for each identified pixel is less than or equal to the maximum number of sub-droplets $SD_{max}$ of the neighbouring nozzle; and generates a mask for the image comprising the selected mask values for the neighbouring nozzle.

The following features apply equally to each of the above aspects.

As will be described in more detail below, all nozzles of a nozzle array may be assigned to print one or more pixels of an image, including the (or each) faulty nozzle. However, as using the faulty nozzle would likely result in image defects, the sub-droplets required to print its assigned pixel(s) are preferably redistributed to one or more neighbouring nozzles. For example, the faulty nozzle sub-droplets could be assigned to a neighbouring nozzle in the same row in the nozzle array as the faulty nozzle. The neighbouring nozzle could be directly adjacent to the faulty nozzle in the same row (or column), or located one, or more than one, nozzle away from the faulty nozzle in the same row (or column). Additionally or alternatively, the faulty nozzle sub-droplets could be assigned to one or more adjacent nozzles in the nozzle array row above the faulty nozzle and/or the nozzle array row below the faulty nozzle. Additionally or alternatively, the faulty nozzle sub-droplets could be assigned to one or more nozzles that are diagonally adjacent to the faulty nozzle in the nozzle array. More generally, the faulty nozzle sub-droplets may be assigned to one or more nozzles which are in the vicinity of the faulty nozzle in the nozzle array. Accordingly, the term "located adjacent to" used herein is used to mean 'located in the vicinity of', such that a neighbouring nozzle is not necessarily located directly next to a faulty nozzle.

It will be understood by a person skilled in the art that the neighbouring nozzle may be located in the same row or the same column in the nozzle array as the faulty nozzle, and that any reference herein to 'row' can equally be replaced with the term 'column' while remaining within the scope of the described techniques.

In embodiments, the apparatus may comprise a single (one) row of nozzles, wherein the neighbouring nozzle is adjacent the faulty nozzle in the row. The neighbouring nozzle may be located on either side of the faulty nozzle. In embodiments, it may be required to distribute the droplets to be printed by the faulty nozzle among two neighbouring nozzles. In this case, the first neighbouring nozzle could be on one side of the faulty nozzle and the second neighbouring nozzle could be on the other side of the faulty nozzle, or both neighbouring nozzles could be located on the same side of the faulty nozzle.

Alternatively, the apparatus may comprise at least a first row of nozzles and a second row of nozzles, wherein the faulty nozzle is located in the first row and wherein the neighbouring nozzle is located in the vicinity of the faulty nozzle in any one of: the first row and the second row. That is, the neighbouring nozzle may be located in the same row as the faulty nozzle, or in the same row as the faulty nozzle but in a different column, or in an adjacent row (e.g. a row above or a row below the row containing the faulty nozzle). If the neighbouring nozzle is located in the same row as the faulty nozzle, it may be located on either side of the faulty nozzle. In embodiments, it may be required to distribute the droplets to be printed by the faulty nozzle among two or more neighbouring nozzles. In this case, a first neighbouring nozzle could be on one side of the faulty nozzle in the same row and the second neighbouring nozzle could be on the other side of the faulty nozzle in the same row, or a first neighbouring nozzle could be located adjacent the faulty nozzle in the same (first) row and the second neighbouring nozzle could be located adjacent the faulty nozzle in the second row.

Further alternatively, the apparatus may comprise at least a first row of nozzles, a second row of nozzles located below the first row, and a third row of nozzles located below the second row, wherein the faulty nozzle is located in the second row and is incapable of ejecting fluid, and wherein the at least one processor is configured to: determine the maximum number of sub-droplets $SD_{max}$ ejectable by a first neighbouring nozzle located in the vicinity of the faulty nozzle in the first row, and a second neighbouring nozzle located in the vicinity of the faulty nozzle in the third row; select, using a lookup table, a mask value for each of the first and second neighbouring nozzles, each mask specifying zero or more sub-droplets to be printed for each identified pixel for each of the first and second neighbouring nozzles, wherein the mask values for each identified pixel are selected is less than or equal to the maximum number of sub-droplets $SD_{max}$ of the first and second neighbouring nozzles. That is, the faulty nozzle is located in the second row, which is sandwiched between the first and third rows. The first neighbouring nozzle could be located in the row above the faulty nozzle and the second neighbouring nozzle could be located in the row below the faulty nozzle. The first and/or second neighbouring nozzle may be or may not be in the same column as the faulty nozzle. For example, as mentioned earlier, the neighbouring nozzle may be located along a diagonal from the faulty nozzle in the nozzle array, such that the neighbouring nozzle may not be in the same column as the faulty nozzle.

In embodiments, the processor is configured to: check that the total number of sub-droplets required to provide the determined pixel colour density for each identified pixel can be assigned to the or each neighbouring nozzle without exceeding the maximum number of sub-droplets $SD_{max}$ of each neighbouring nozzle. Preferably, if the processor determines the maximum number of sub-droplets $SD_{max}$ of the or each neighbouring nozzle will be exceeded, the processor is configured to: determine a number of remaining sub-droplets for the faulty nozzle which have not been allocated to the or each neighbouring nozzle; determine at least one further nozzle capable of ejecting at least part of the remaining sub-droplets; and select a mask for the at least one further nozzle, the mask specifying one or more sub-droplets to be printed for the pixel.

In other words, if a neighbouring nozzle is unable to eject all of the faulty nozzle sub-droplets in addition to the sub-droplets it is assigned to eject itself without exceeding $SD_{max}$, then the faulty nozzle sub-droplets may be distributed across two or more neighbouring nozzles. Similarly, if two or more neighbouring nozzles which have been selected to eject some of the faulty nozzle sub-droplets are unable to do so in addition to the sub-droplets they are already assigned to eject without exceeding $SD_{max}$, then the faulty nozzle sub-droplets may be distributed among further neighbouring nozzles. In each case, the processor may determine how many of the faulty nozzle sub-droplets the or each neighbouring nozzle is able to deposit without exceeding $SD_{max}$, calculate the remaining number of faulty nozzle sub-droplets and spread/propagate the remaining number of sub-droplets among one or more neighbouring nozzles that are in the general vicinity of the faulty nozzle in the nozzle array. Thus, the faulty nozzle sub-droplets may be dispersed among a number of neighbouring nozzles depending on the capacity (remaining capacity) of each neighbouring nozzle. The processor uses the lookup table to determine how to distribute the sub-droplets between the neighbouring nozzles.

In embodiments, the faulty nozzle(s) may be identified during manufacture of the apparatus, and data identifying the faulty nozzle(s) may be stored in the apparatus to enable the mask to be generated efficiently. However, in embodiments, the apparatus may be configured to identify nozzles which become faulty post-manufacture (e.g. as a result of prolonged usage). Thus, the apparatus may comprise a fault detection means configured to detect a fault in the nozzles. In this case, the at least one processor may be configured to receive data indicating that a nozzle is faulty from the fault detection means. The processor may use this received data to perform the mask generation process described herein, and may store this received data for use in subsequent mask generation processes.

In embodiments, the apparatus comprises a data store configured to store the lookup table. The data store may also store the above-mentioned data identifying the faulty nozzle(s).

In embodiments, the data store is configured to store calibration data identifying at least one faulty nozzle of the droplet deposition head. Preferably, the data store may be configured to store data identifying at least one predetermined neighbouring nozzle to be used to deposit fluid instead of each faulty nozzle, wherein the predetermined neighbouring nozzle is located in any one or more of: a row containing the faulty nozzle, a row above the row containing the faulty nozzle, and a row below the row containing the faulty nozzle. Storing this information may speed-up the mask generation process, as the processor is provided with an indication of which nozzle(s) should receive the droplets that the faulty nozzle is unable to deposit.

In embodiments, the at least one processor is configured to: determine an average number of sub-droplets ejected by each nozzle of the droplet deposition head; identify one or more nozzles that are configured to eject a number of sub-droplets greater than the average number of sub-droplets; identify one or more nozzles that are configured to eject a number of sub-droplets less than the average number of sub-droplets; and select, using the lookup table, a mask value for each nozzle of the droplet deposition head to perform load-balancing across the nozzles. This may enable workload sharing between nozzles, which may improve the overall lifetime of each nozzle as the chance of some nozzles being used significantly more than other nozzles may be reduced. Furthermore, the process may ensure that particular neighbouring nozzle(s) adjacent a faulty nozzle are not overused, or used significantly more often than other nozzles adjacent the faulty nozzle, by switching which neighbouring nozzle(s) is used for each print job (or after a certain number of print jobs).

In embodiments, the lookup table is a two-dimensional array having at least two columns, each column containing mask values for a varying pixel colour density, and wherein the at least one processor is configured to: select mask values for each identified pixel by selecting a value from one of the at least two columns dependent on the determined total number of sub-droplets.

In embodiments, the at least one processor is configured to: select a mask value for the or each neighbouring nozzle such that the total number of sub-droplets specified by the selected mask values provides a pixel colour density for each pixel that is a function of the determined pixel colour density of the pixel.

In embodiments, the plurality of nozzles are operated by at least one actuator element, and the apparatus further comprises a drive waveform generator configured to: receive the generated mask for the image; generate a drive waveform for each nozzle dependent on the received mask; and transmit the generated drive waveforms to the at least one actuator element to operate the nozzles.

In embodiments, wherein a set of nozzles are operated by at least one actuator element using a common drive signal, and wherein the apparatus further comprises a drive waveform generator configured to: receive the generated mask for the image; modify the common drive signal provided to the set of nozzles of each nozzle array dependent on the received masks; and transmit the modified common drive signal to the at least one actuator to operate the set of nozzles.

In embodiments, the interface is configured to receive a greyscale image to be printed, that is an image comprising shades of grey (varying from black to white). The greyscale image may comprise 256 different intensities (shades of grey), or fewer or greater numbers of intensities. Additionally or alternatively, the interface may be configured to receive a colour image to be printed. The colour image (e.g. a digital colour image) may be, for example, an image formed using a RGB colour model, a CMY colour model, a YCbCr colour model, or an HSV colour model, or formed from any other colour space/model. The term "greyscale" used herein generally means the different densities or tones of colour within an image of any colour (not necessarily just black). Accordingly, the term "greyscale image" used herein means any image comprising different densities or tones of any colour.

In embodiments, the interface of the circuitry/droplet deposition apparatus is configured to receive a half-toned image to be printed. This may reduce the amount of image processing that needs to be performed by the circuitry/processor/droplet deposition apparatus, and may also reduce the complexity of the masking technique. For example, a continuous tone image usually contains a very large range of colours or greys (also known as tones), such as from 0 to 255 tones, and the image may have 8 bits/pixel. In contrast, a half-toned image reduces the visual reproductions to an image that is printed with only a limited number of colours of ink, using dots of differing sizes or spacings. A half-toned version of a continuous tone image may have between 1 and 4 bits/pixel (e.g. 1 bit/pixel, 2 bits/pixel, 3 bits/pixel or 4 bits/pixel). Thus, if a half-toned image is received, then less data is received and less data may need to be processed when applying a mask. Furthermore, fewer/smaller lookup tables (LUTs) for the masking process may be required because the half-toned image contains many fewer tones than a continuous tone image. Thus, applying a masking technique to a half-toned image may require less processing power/simpler circuitry (which is also less expensive to manufacture and operate), less storage space to store the lookup table, fewer options within a lookup table for mask values (or a simpler lookup table than for continuous tone images), and faster, more efficient application of the masking technique.

Generally speaking, the lookup table used by the apparatus is generated on a separate computing device (as explained in more detail below) and provided to the apparatus for use. However, in embodiments, the lookup table may be generated by the at least one processor of the apparatus.

In embodiments, each of the plurality of nozzles are configured to eject droplets of varying sizes. A droplet ejected by a nozzle may be formed of one or more sub-droplets. Accordingly, the droplet size of the droplet ejected by a nozzle may depend on the number of sub-droplets ejected by the nozzle.

In embodiments, the or each neighbouring nozzle of the droplet deposition head is configured to eject a pre-defined maximum number of sub-droplets. Preferably, the at least one processor is configured to: receive the pre-defined maximum number of sub-droplets ejectable by each neighbouring nozzle; filter out any mask values from the lookup table which specify a sub-droplet value that exceeds the pre-defined maximum number of sub-droplets for each identified pixel; and select a mask value from the filtered lookup table, for each neighbouring nozzle, each mask value specifying zero or more sub-droplets to be printed for each identified pixel by the neighbouring nozzle instead of the faulty nozzle (such that the total number of sub droplets per pixel does not exceed the pre-defined maximum number).

In embodiments, the method for printing an image comprises operating the neighbouring nozzle to eject zero or more sub-droplets according to the generated mask, such that the determined pixel colour density for each identified pixel assigned to the faulty nozzle is provided by the at least one neighbouring nozzle.

In embodiments, the circuitry is configured to operate the neighbouring nozzle to eject zero or more sub-droplets according to the generated mask, such that the determined pixel colour density for each identified pixel assigned to the faulty nozzle is provided by the at least one neighbouring nozzle.

According to a related aspect of the present technique, there is provided a non-transitory data carrier carrying code which, when implemented on a processor, causes the processor to carry out the methods described herein.

As will be appreciated by one skilled in the art, the present techniques may be embodied as a system, method or computer program product. Accordingly, present techniques may take the form of an entirely hardware embodiment, an entirely software embodiment, or an embodiment combining software and hardware aspects.

Furthermore, the present techniques may take the form of a computer program product embodied in a computer readable medium having computer readable program code embodied thereon. The computer readable medium may be a computer readable signal medium or a computer readable storage medium. A computer readable medium may be, for example, but is not limited to, an electronic, magnetic, optical, electromagnetic, infrared, or semiconductor system, apparatus, or device, or any suitable combination of the foregoing.

The techniques further provide processor control code (or logic) to implement the above-described methods, for example on a general purpose computer system, or on a digital signal processor (DSP), or on a Field-programmable gate array (FPGA). The techniques also provide a carrier carrying processor control code to, when running, implement any of the above methods, in particular on a non-transitory data carrier—such as a disk, microprocessor, CD- or DVD-ROM, programmed memory such as read-only memory (firmware), or on a data carrier such as an optical or electrical signal carrier. The code may be provided on a carrier such as a disk, a microprocessor, CD- or DVD-ROM, programmed memory such as non-volatile memory (e.g. Flash) or read-only memory (firmware). The program code or logic (and/or data) to implement embodiments of the techniques may comprise source, object or executable code in a conventional programming language (interpreted or compiled) such as C, or assembly code, code for setting up or controlling an ASIC (Application Specific Integrated Circuit) or FPGA (Field Programmable Gate Array), or code for a hardware description language such as Verilog™ or VHDL (Very high speed integrated circuit Hardware Description Language). As the skilled person will appreciate, such code and/or data may be distributed between a plurality of coupled components in communication with one another. The techniques may comprise a controller which includes a microprocessor, working memory and program memory coupled to one or more of the components of the system.

Computer program code for carrying out operations for the above-described techniques may be written in any combination of one or more programming languages, including object oriented programming languages and conventional procedural programming languages. Code components may be embodied as procedures, methods or the like, and may comprise sub-components which may take the form of instructions or sequences of instructions at any of the levels of abstraction, from the direct machine instructions of a native instruction set to high-level compiled or interpreted language constructs.

It will also be understood by a person skilled in the art that all or part of a logical method according to the preferred embodiments of the present techniques may suitably be embodied in a logic apparatus comprising logic elements to perform the steps of the above-described methods, and that such logic elements may comprise components such as logic gates in, for example a programmable logic array or application-specific integrated circuit. Such a logic arrangement may further be embodied in enabling elements for temporarily or permanently establishing logic structures in such an array or circuit using, for example, a virtual hardware descriptor language, which may be stored and transmitted using fixed or transmittable carrier media.

In an embodiment, the present techniques may be realised in the form of a data carrier having functional data thereon, said functional data comprising functional computer data structures to, when loaded into a computer system, or processor, or network, and operated upon thereby, enable said computer system (or processor or network) to perform all the steps of the methods described herein.

A variety of alternative fluids may be deposited by a droplet deposition head. For instance, a droplet deposition head may eject droplets of ink that may travel to a droplet receiving medium, such as a sheet of paper or card, or to other receiving media, such as ceramic tiles or shaped articles (e.g. cans, bottles, etc.) to form an image, as is the case in inkjet printing applications (where the droplet deposition head may be an inkjet printhead or, more particular, a drop-on-demand inkjet printhead). Thus, the term 'droplet deposition head' is used interchangeably herein with the term 'inkjet printhead' or 'printhead', without loss of generality. Similarly, the term 'fluid' is used interchangeably herein with the term 'ink', without loss of generality. The term 'ink-ejecting nozzle' is used interchangeably herein with 'nozzle'.

Alternatively, droplets of fluid may be used to build structures. For example, electrically active fluids may be deposited onto receiving media such as a circuit board so as to enable prototyping of electrical devices. In another example, polymer containing fluids or molten polymer may be deposited in successive layers so as to produce a prototype model of an object (as in 3D printing). In other examples, droplet deposition heads may be adapted to deposit droplets of solution containing biological or chemical material onto a receiving medium such as a microarray. Droplet deposition heads suitable for such alternative fluids may be generally similar in construction to printheads, and/or may be adapted to handle the specific fluid in question. Droplet deposition heads as described in the following disclosure may be drop-on-demand droplet deposition heads. In such heads, the pattern of droplets ejected may vary, dependent upon the input data provided to the head.

Turning now to the Figures, by way of example only, we outline an apparatus which may be used to implement the masking techniques described herein. FIG. 1 shows a block diagram of a system 10 which may be used to configure a droplet deposition head 22 (or printhead) to print an image. The system comprises a droplet deposition apparatus 26, such as a printer, which is configured to print images. The term 'image' is used herein to mean any data that is to be printed or otherwise replicated/reproduced, which may include an image, a picture, a photograph, text, a barcode, a 3D object, and so on. The 'image' may be a pre-processed image, e.g. one which has been subjected to at least a half-toning image transformation that reduces every pixel of the original image into a pixel colour density or similar value which indicates how many drops of ink are required to reproduce the pixel.

The droplet deposition apparatus/printer 26 comprises at least one droplet deposition head 22, which has a plurality of nozzles arranged in a nozzle array 30. The nozzle array 30 may comprise a single row of nozzles, two rows of nozzles, or multiple rows of nozzles. Each droplet deposition head 22 may comprise at least one nozzle array 30. (The dashed nozzle array 30 represents one or more additional nozzle arrays which may exist on a droplet deposition head 22). The nozzles of the or each nozzle array 30 are controlled to selectively eject fluid to print an image. The or each droplet deposition head 22 is controlled using droplet deposition head control circuitry 12. Each droplet deposition head may be controlled by dedicated control circuitry. Additionally or alternatively, if multiple droplet deposition heads 22 are provided within apparatus 26, they may be controlled by shared control circuitry (not shown) or by dedicated circuitry for each droplet deposition head.

The droplet deposition head control circuitry 12 comprises at least one processor 16 coupled to at least one memory 20. The memory 20 may comprise program memory storing computer program code to implement the droplet deposition head control process described herein, and to working memory. The program memory of memory 20 may be used for buffering data (e.g. image data received by the droplet deposition head control circuitry 12) while executing the computer program code. The processor 16 may comprise processing logic to process data (e.g. image data, programs, instructions received from a user, etc.) and generate output signals in response to the processing. The control circuitry 12 may comprise any suitable circuitry or logic, and may, for example, comprise any one or more of the following: a field programmable gate array (FPGA), system on chip device, microprocessor device, microcontroller, and one or more integrated circuits.

The control circuitry 12 comprises interfaces 14, such as a conventional computer screen, keyboard, and mouse, and/or other interfaces such as a network interface and software interfaces (e.g. a data store interface). The interfaces 14 preferably comprise a communication interface to receive an image or image data for printing, which may be processed image data. The communication interface of interfaces 14 may be configured to receive data or data signals from one or more external devices (such as computing device 24). The communication interface may be a communication module or unit. The communication interface may be configured to receive image data sent from external computing device 24, and may be coupled to a network interface to receive the data from computing device 24. The communication interface may be configured to receive data via any one or more of the following: a Universal Serial Bus (USB), IEEE1394 interface, Ethernet, wireless network, and a parallel interface.

The control circuitry 12 comprises a data store 18 configured to store, for example, one or more lookup tables used to configure the nozzles of the or each nozzle array 30. Data store 18 may be coupled to the communication interface of interfaces 14 to, for example, receive data. Data store 18 may be coupled to lookup table (LUT) generator 32 (if this optional LUT generator is provided within control circuitry 12). The data store 18 may be configured to communicate with the at least one processor 16.

The memory 20 and/or the data store 18 may comprise a volatile memory such as random access memory (RAM), for use as temporary memory whilst the control circuitry 12 is operational. Additionally or alternatively, the memory 20 and data storage 18 may comprise non-volatile memory such as Flash, read only memory (ROM) or electrically erasable programmable ROM (EEPROM), for storing data, programs, or instructions received or processed by the control circuitry 12.

The control circuitry 12 may further comprise a drive waveform generator 28. The drive waveform generator 28 may be configured receive data from processor 16, and may be configured to generate drive waveforms or drive signals (based on the received data) for each nozzle of the or each nozzle array 30. The drive waveforms or drive signals control when and how each nozzle ejects fluid. In particular embodiments, the drive waveform generator 28 may be configured to generate a drive waveform/signal for each nozzle dependent on masks selected for a particular masking technique. Additionally or alternatively, a common drive signal may be provided to the nozzles and the drive waveform generator 28 may be configured to modify the common drive signal provided to multiple nozzles dependent on masks selected for a particular masking technique.

As explained in more detail below, the control circuitry 12 (or specifically, the processor 16) is configured to select masks (also known as 'print masks') which specify which nozzles of the or each nozzle array 30 should eject fluid (and when they should eject fluid) to print an image (or image data) received by one of the interfaces 14 (e.g. a communication interface). Typically, each mask is a two-dimensional array that is associated in a pixel-by-pixel to the image. A mask may be generated for each pass of the droplet deposition head over a receiving medium. (In embodiments, the droplet deposition head may only pass over the receiving medium once per image to be printed). Accordingly, when multi-pass printing is deployed, a mask is generated for each pass of the droplet deposition head and these may wholly or partially overlap each other. In a particular embodiment, the number of rows in the mask is equal to the number of nozzles of each nozzle array 30. If the apparatus comprises multiple nozzle arrays, a mask is generated for each nozzle array. If the apparatus operates in a multi-pass mode, a mask is generated for each pass. If the apparatus comprises multiple nozzle arrays and operates in a multi-pass mode, a mask is generated for each pass of each nozzle array. In each case, the masks are generated to ensure that an adequate amount of fluid is deposited to form each pixel of the image. The amount of fluid to be deposited may or may not be uniform across the mask.

The control circuitry 12 may receive as an input a processed image which is to be printed, and to which a masking technique is to be applied. The processed image may be, for example, an image to which one or more image data transformations (such as colour correction, colour separation, linearization, half-toning, etc.) have been applied. The processing/image transformations may be performed by circuitry, a processor or a computing device (such as computing device 24) which is located remote to the control circuitry 12 which implements the masking technique. Typically, an image to be printed is processed so that it is in a suitable form for an apparatus which is to print the image. Some processing is low spatial resolution processing, also known as multi-nozzle processing, and may comprise image transformations such as colour correction, half-toning, etc. Some processing is high spatial resolution processing, which requires knowledge of the droplet deposition head 22 used to print the image and is applicable to a single nozzle. High spatial resolution processing comprises image transformations such as trimming, masking and image alignment, and usually requires knowledge of the physical properties of the droplet deposition head 22. The physical properties may include information on how many nozzle arrays 30 are within each droplet deposition head 22, how many nozzles exist in each nozzle array 30 and how they are arranged (e.g. number of rows/columns), whether the nozzle arrays overlap, whether the nozzles are capable of ejecting droplets of differing sizes/volumes, how many droplets a nozzle is capable of ejecting in each nozzle actuation, etc.

In embodiments, the control circuitry 12 receives a processed image, e.g. one which has been subjected to low spatial resolution processing/multi-nozzle processing. Preferably, the control circuitry 12 receives a processed image which has at least been subjected to a half-toning image transformation. This is advantageous because this reduces the amount of image processing that needs to be performed by the control circuitry 12, and may also reduce the complexity of the masking technique. For example, a continuous tone image usually contains a very large range of colours or greys (also known as tones), such as from 0 to 255 tones, and the image may have 8 bits/pixel. In contrast, a half-toned image reduces the visual reproductions to an image that is printed with only a limited number of colours of ink, using dots of differing sizes or spacings. A half-toned version of a continuous tone image may generally have a bits/pixel value that is less than 8 bits/pixel (which is the continuous tone image value), and is preferably between 1 and 4 bits/pixel (e.g. 1 bit/pixel, 2 bits/pixel, 3 bits/pixel or 4 bits/pixel).

Thus, if the control circuitry 12 receives a half-toned image, then the control circuitry 12 receives less data and may have to process less data when applying a mask. Furthermore, fewer lookup tables (LUTs), or smaller sized LUTs, for the masking process may be required because the half-toned image contains many fewer tones than a continuous tone image. The smaller sized LUTs may have fewer columns/rows than LUTs which are used to generate masks for unprocessed, continuous tone images (which contain a much larger range of tones), and therefore the smaller sized LUTs require less storage space and may be simpler to use than those used for continuous tone images. As the masks that specify which nozzles of the or each nozzle array 30 should eject fluid (and when they should eject fluid) to print an image, may depend on the number of tones within an image, then reducing the number of tones in an image printed may mean fewer possible mask values are required. Thus, applying a masking technique to a half-toned image may require less processing power/simpler control circuitry (which is also less expensive to manufacture and operate), fewer options within a lookup table for mask values (or a simpler lookup table than for continuous tone images), and faster, more efficient application of the masking technique.

As explained in more detail below, mask values are selected from a lookup table (LUT) (not shown in FIG. 1), which may be stored in the data store 18, and used to generate (or populate) the mask for each pass and/or each nozzle array. A lookup table is generated by a lookup table generator 32, which may be provided on an external computing device 24 or within the apparatus 26 (e.g. within the droplet deposition head control circuitry 12). In preferred embodiments, the lookup table generator 32 is programmed by a manufacturer of apparatus 26 to, for example, suit the particular technical specification or characteristics of the apparatus 26. Typically, an end user of the apparatus 26 is unable to reprogram the lookup table generator 32, but may be able to configure the lookup table generator (and therefore, the mask values it generates). The lookup table generator 32 may be a piece of software or an algorithm.

The lookup table generator may optionally be provided in apparatus 26 (as indicated in FIG. 1 by the dashed box). In this embodiment, the lookup table may be configurable by a manufacturer of apparatus 26 or by an end user, typically by using a computing device 24, which is coupled to but external to apparatus 26. Optionally, the lookup table may be pre-defined and may be pre-stored in data store 18 by the manufacturer of apparatus 26.

The lookup table generator 32 preferably enables the apparatus manufacturer (or end user) to configure the lookup table for each individual apparatus 26 depending on, for example, their printing requirements or the technical specification of the apparatus 26. For example, a droplet deposition head 22 of an apparatus 26 may be configured to provide differing volumes of fluid when a nozzle of the nozzle array 30 is caused to eject fluid. Although a nozzle array 30 is typically formed of multiple rows of identical nozzles which are designed to eject droplets of a particular, pre-defined size, some nozzles may, due to manufacturing tolerances and process variations, eject droplets which are smaller or bigger than the pre-defined droplet size. The manufacturer of apparatus 26 may be able to determine these nozzles and configure the lookup table to comprises masks that control how these nozzles eject fluid to account for the size of droplet they eject. Similarly, if the apparatus 26 is configured for multi-pass printing, the manufacturer (or end user) may be able to configure the lookup table to suit multi-pass printing. Accordingly, the lookup table may be configurable (using the LUT generator 32 on computing device 24) for each individual printer 26, or for sets of printers 26 which are manufactured according to the same design. Once the lookup table has been configured, it is provided to the or each apparatus 26, where it is preferably stored in data store 18.

However, in additional or alternative embodiments, the LUT generator 32 may be provided on computing device 24, which is external to apparatus 26, as shown in FIG. 1. In such an arrangement, the lookup table generator 32 may be programmed by the manufacturer of apparatus 26, and the generated lookup table or tables are stored within data store 18. The lookup tables may be configurable, or reconfigurable, by the manufacturer or by an end-user of the apparatus 26. For example, if one or more nozzles of the nozzle array 30 become defective over time, or begin to eject droplets which are smaller or bigger than the pre-defined droplet size, the end user may be able to use the computing device 24 to configure the lookup tables generated by LUT generator 32 (which is located either on computing device 24 or in apparatus 26), to account for the new behaviour of the nozzles. This may enable the apparatus 26 to achieve high performance and high quality printing over time, since the lookup table may be alterable. A manufacturer or user of apparatus 26 may be able to perform calibration of the apparatus 26 (or specifically, of the droplet deposition head 22 and nozzle array 30), to determine the behaviour of the nozzles, and use this information to reconfigure the stored lookup table using the LUT generator 32.

An advantage of applying the present masking techniques to a pre-processed image, particularly a half-toned image, is that the masking technique may be based upon the droplet number and/or size that nozzles of the apparatus 26 are capable of ejecting. Specifically, the lookup tables may provide mask values which are specific to the properties of the apparatus 26 (and in particular the nozzles). For example, the pre-processing may mean that each pixel of the image is defined in terms of a number of sub-droplets to be deposited by a nozzle (e.g. between zero and four sub-droplets of a particular ink colour). This means the possible mask values within a lookup table are significantly reduced, as they are defined in terms of sub-droplets, rather than in terms of a large range of tones (e.g. 0 to 255 tones). In contrast, masking techniques/mask values/LUTs provided for unprocessed, continuous tone images may not be specific to the properties of the apparatus 26, and per-nozzle processing may only be performed after a mask has been generated for a continuous tone image. This may be an ineffective way of applying a masking technique.

The apparatus 26 may optionally comprise fault detection means (or fault detector) 21, as shown in FIG. 1. The fault detector 21 may be part of the droplet deposition head control circuitry 12, or may be provided as a separate module or as separate circuitry that is coupled to the control circuitry 12. In embodiments, the apparatus may be configured to identify nozzles which become faulty post-manufacture (e.g. as a result of prolonged usage). The fault detector 21 may be configured to detect a fault in the nozzles (i.e. a faulty nozzle). The at least one processor 16 may be configured to receive data indicating that a nozzle is faulty from the fault detector 21. The processor 16 may use this received data to perform the mask generation process described below, and may store this received data (e.g. in data store 18) for use in subsequent mask generation processes.

As mentioned above, a droplet deposition apparatus, such as an inkjet printer, prints dots by ejecting small droplets of fluid onto receiving media. The image (or image data) to be printed is usually formed of multiple pixels, but could comprise a single pixel. The or each pixel of the image is allocated to a particular nozzle of a nozzle array 30 of the printer 26, such that the allocated nozzle is used to deposit the fluid droplets required to reproduce the image pixel on the receiving medium. When multi-pass printing is used, each droplet deposition head 22 uses a 'multi-pass print mask' (also known as a 'print mask') to determine which nozzles of the nozzle array are to eject fluid during each pass. For example, in a four-pass printing mode, each pixel location on the print medium will be passed over four times by a particular nozzle that is responsible for depositing fluid to form that pixel. A print mask is used to ensure that a pixel location does not receive more or less than the required amount of fluid.

Conventionally, a pixel of an image to be printed formed on the receiving medium by at least one droplet of fluid. A droplet may be divided into multiple sub-droplets which may be printed at different times (e.g. by different passes of a droplet deposition head 22 over a receiving medium) and/or by multiple nozzles. This process is called masking and it usually improves the interaction between the fluid and the receiving medium, and the effect of this interaction on image quality. For example, masking may ensure that adjacent nozzles are not ejecting fluid at the same time, which could reduce bleed and coalescence of fluid droplets. The masking process may also reduce the impact of dot placement inaccuracy on the overall print image quality, by, for example, using multiple nozzles to spread or hide a deviation of droplet volume (or droplet size) from a specific nozzle from an expected droplet volume (or size). Common masking techniques typically divide the droplets of an image into sub-groups of droplets without taking into account the droplet size that a nozzle of a nozzle array is capable of providing, or without taking into account the number of droplets required to print a particular pixel of the image. For instance, an image may comprise pixels of different colour densities/intensities (e.g. different grey levels for a greyscale image, or different levels for a colour image) and therefore, multiple droplets of fluid may be required to provide particular colour/grey levels for particular pixels. Conventional masking techniques are therefore not optimal for printing greyscale images, or for printing images using nozzles capable of ejecting varying sizes of droplet.

Figure 2:
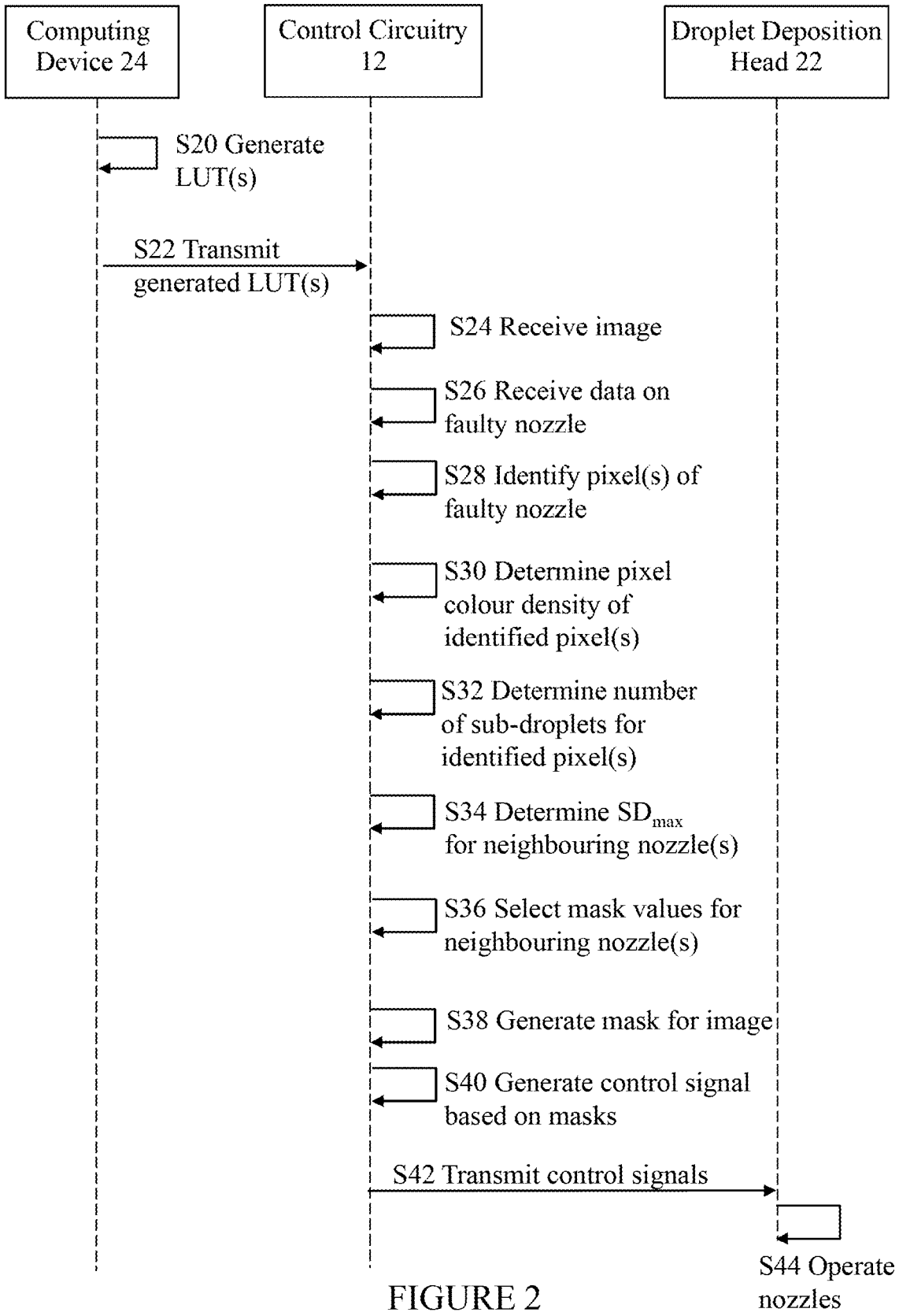
FIG. 2 shows a schematic flow diagram of the steps of using control circuitry to apply a masking technique to control droplets ejected by a droplet deposition head having at least one faulty nozzle.

Turning now to FIG. 2, this shows a schematic flow diagram of the steps to apply a masking technique to control the droplets ejected by a droplet deposition head of a printing apparatus 26, where the nozzle array 30 comprises at least one faulty nozzle. The term "faulty nozzle" is used herein to mean a non-existent nozzle or missing nozzle, a nozzle which is functional but is misaligned (such that, for example, it ejects droplets at an angle to the receiving medium), or is clogged due to fluid drying in/on the nozzle, or is non-functional or partially functional. In each case, it is preferred to use at least one neighbouring nozzle to deposit the droplets that the faulty nozzle is assigned to deposit. It will be understood by a person skilled in the art that the order of steps shown in FIG. 2 is merely one example, and that particular steps may be performed in a different order, or by different elements/circuitry/modules within the apparatus 26.

As mentioned above, a lookup table (LUT) is generated by a computing device 24 (step S20), though it may be generated or reconfigured by a lookup table generator on the apparatus 26 itself. The or each LUT generated by the computing device 24 (or apparatus 26) is provided to the control circuitry 12 of the apparatus 26 (step S22), and is typically stored in data store 18 as explained above. The control circuitry receives an image or image data for printing (S24). The image or image data may be processed by the control circuitry to make it suitable for printing by the apparatus 26, or it may be pre-processed. For example, the image or image data may have been pre-processed using a half-toning image transformation to reduce the number of tones within the image, and/or to reduce the number of bits/pixel in the image (and thereby reduce the size of the data received by and processed by the control circuitry 12). The image may be a greyscale image. The control circuitry 12 (or specifically, at least one processor 16) is configured to receive data indicating that at least one nozzle in a row of the nozzle array 30 is faulty (step S26), and identify each pixel of the image that is assigned to be printed by the faulty nozzle (step S28). This may enable the droplets required to form the pixel to be redistributed to one or more neighbouring nozzles adjacent to (or in the vicinity of) the faulty nozzle.

The control circuitry 12 (or specifically, at least one processor 16) is configured to determine a pixel colour density for each identified pixel of the image (step S30), for example by performing some image processing to convert pixel values into colour levels/greyscale levels or a pixel colour density. That is, the processor analyses the received image to determine the pixel colour density $G_{i,j}$ required to form each pixel $p_{i,j}$ of the image, where $G_{i,j}$ may be an integer value. The integer value of the pixel colour density may indicate how many sub-droplets are required to form each pixel of the image on the receiving medium. This is particularly important when printing a greyscale image (i.e. an image comprising different densities or tones of any colour, also referred to as a multi-tone or multi-level image), as multiple droplets (or sub-droplets) of fluid may be required to provide a dot of a particular density level/tone. Once the pixel colour density has been determined for each pixel of the image, the processor is configured to determine a total number of sub-droplets required to provide the determined pixel colour density for each pixel (step S32). Typically, the number of sub-droplets required increases with $G_{i,j}$, that is, a higher colour density will generally require more sub-droplets to produce a dot of that density level/tone than a lower colour density.

The apparatus 26 is configured to determine the maximum number of sub-droplets $SD_{max}$ ejectable by at least one neighbouring nozzle located adjacent to the faulty nozzle (step S34). The value of $SD_{max}$ for each neighbouring nozzle may be used to ensure that, in the faulty nozzle droplet redistribution process the neighbouring nozzle is not assigned more sub-droplets to print than it is capable of printing. As mentioned earlier, the or each neighbouring nozzle may not be directly adjacent the faulty nozzle, but may be in the vicinity of the faulty nozzle in the nozzle array. Accordingly, the term "located adjacent to" used herein is used to mean 'located in the vicinity of', such that a neighbouring nozzle is not necessarily located directly next to a faulty nozzle.

The processor 16 of the apparatus is configured to select, using a lookup table, a mask value for the neighbouring nozzle, each mask value specifying zero or more sub-droplets to be printed for each identified pixel by the neighbouring nozzle instead of the faulty nozzle, wherein the mask value for each identified pixel is less than or equal to the maximum number of sub-droplets $SD_{max}$ of the neighbouring nozzle (step S36).

Figure 5:
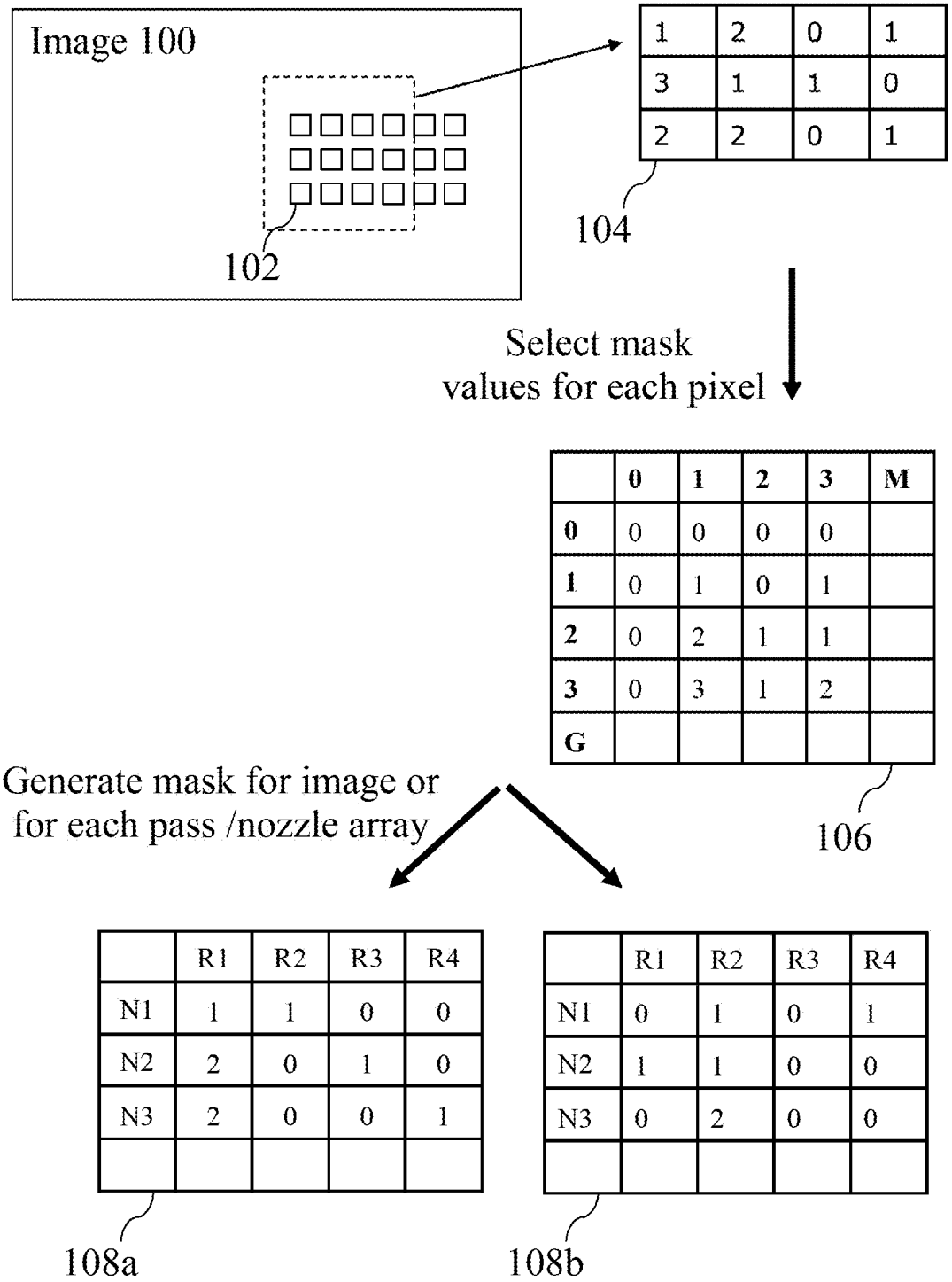
FIG. 5 shows a schematic diagram of how pixel colour density is determined for an image and used to apply a masking technique to control droplets ejected by a droplet deposition head.

FIG. 5 shows a schematic diagram of how pixel colour density may be determined for an image and used to generate one or more masks. An image 100 may comprise multiple pixels 102 (indicated by the small squares). As explained above, the pixel colour density is determined for each pixel 102 of the image 100. FIG. 8 shows how masks are generated for a subset of the pixels (indicated by the dashed box). The determined pixel colour density for each pixel 102 in the subset of pixels is shown in array 104. For example, the leftmost pixel in the top row of the array has a pixel colour density of 1, indicating a single sub-droplet is required to form a dot of that pixel colour density, while the leftmost pixel in the second row of the array has a pixel colour density of 3, indicating three sub-droplets are required to form a dot of that pixel colour density.

An example lookup table 106 is shown in FIG. 5. The lookup table (LUT) 106 is a two-dimensional table indexed by pixel colour density values (G) and mask values (M). For each functioning nozzle of nozzle array 30, the processor is configured to select a mask value which specifies how many sub-droplets a particular nozzle needs to deposit for a particular pixel of the array. If the droplet deposition head is operating in a single-pass mode (where the droplet deposition head moves over the receiving medium once), each functioning nozzle may be used to print all of the sub-droplets required to provide the pixel colour density of the or each pixel it is assigned to print. In this case, if a faulty nozzle is identified, the sub-droplets it is required to provide for its assigned pixel(s) are distributed to one or more neighbouring nozzles. If only a single neighbouring nozzle is selected to deposit the sub-droplets that the faulty nozzle is supposed to deposit, then the processor may simply assign all of these sub-droplets to the neighbouring nozzle. However, if the neighbouring nozzle(s) are unable to eject these faulty nozzle sub-droplets in addition to the sub-droplets it is assigned to deposit itself, then the faulty nozzle sub-droplets may be distributed across two or more neighbouring nozzles. In this case, the processor 16 may use the lookup table to determine how to distribute the sub-droplets between the neighbouring nozzles.

For example, if a neighbouring nozzle is unable to eject all of the faulty nozzle sub-droplets in addition to the sub-droplets it is assigned to eject itself without exceeding $SD_{max}$, then the faulty nozzle sub-droplets may be distributed across one or more further neighbouring nozzles. Similarly, if two or more neighbouring nozzles which have been selected to eject some of the faulty nozzle sub-droplets are unable to do so in addition to the sub-droplets they are already assigned to eject without exceeding $SD_{max}$, then the faulty nozzle sub-droplets may be distributed among further neighbouring nozzles. In each case, the processor 16 may determine how many of the faulty nozzle sub-droplets the or each neighbouring nozzle is able to deposit without exceeding $SD_{max}$, calculate the remaining number of faulty nozzle sub-droplets (which have not been assigned to the neighbouring nozzle(s)) and spread/propagate the remaining number of sub-droplets among one or more further neighbouring nozzles that are in the general vicinity of the faulty nozzle in the nozzle array. Thus, the faulty nozzle sub-droplets may be dispersed among a number of neighbouring nozzles depending on the capacity (remaining capacity) of each neighbouring nozzle. The processor 16 uses the lookup table to determine how to distribute the sub-droplets between the neighbouring nozzles.

For example, if the faulty nozzle sub-droplets are distributed across two neighbouring nozzles, a mask value is selected from one column of the LUT 106 for the first neighbouring nozzle and from a second column for the second neighbouring nozzle, for each identified pixel (i.e. each pixel assigned to the faulty nozzle). For example, if the pixel colour density value (G) of a pixel is 1 (indicating one sub-droplet is required), the processor 16 is configured to view the G=1 row of the LUT 106, and select mask values from two different columns which provide the required number of sub-droplets (one). For example, the processor could select the appropriate mask values from column 0 and column 1 (such that the neighbouring nozzle ejects no fluid, and the second neighbouring nozzle ejects one sub-droplet), or from column 2 and column 3 (such that the first neighbouring nozzle ejects one sub-droplet, and the second neighbouring nozzle ejects no fluid). In another example, if the pixel colour density value (G) of a pixel is 3 (indicating three sub-droplets are required), the processor is configured to view the G=3 row of the LUT 106, and select mask values from two different columns which together provide the required number of sub-droplets (three). For example, the processor could select the appropriate mask values from columns 0 and 1 (such that the first neighbouring nozzle ejects no ink, and the second neighbouring nozzle ejects three sub-droplets), or columns 2 and 3 (such that the first neighbouring nozzle ejects one sub-droplet, and the second neighbouring nozzle ejects two sub-droplets). In each example, the total number of sub-droplets required to form a dot of a particular pixel colour density is provided across both neighbouring nozzles. (It will be appreciated that the distribution of sub-droplets across the neighbouring nozzles may mean that a nozzle is assigned a 'null' or 'zero' mask value.)

Turning back to FIG. 2, once the mask values have been selected for each nozzle (including the neighbouring nozzle (s)), the processor 16 of the apparatus is configured to generate a mask for the image using the selected mask values for each pass (step S38). In response to the mask generation, the processor 16 or the drive waveform generator 28 may generate a control signal/drive signal for each nozzle of the nozzle array(s) (or for the whole nozzle array) based on the values in each mask (step S40). The control/drive signals are then transmitted to the droplet deposition head 22 (specifically to at least one actuator element coupled to the nozzles) (step S42). The drive signals are used to operate the droplet deposition head to eject zero or more sub-droplets from the neighbouring nozzle according to the generated mask, such that the determined pixel colour density for each identified pixel assigned to the faulty nozzle is provided by the at least one neighbouring nozzle (step S44).

The apparatus of FIG. 1 may be used to perform multi-pass printing, in which the droplet deposition head 22 is configured to pass over a receiving medium more than once in order to deposit the fluid required to form the image to be printed. In this operation mode, the processor 16 of the apparatus 26 may be configured to determine a number of passes N of the droplet deposition head to print the received image. The number of passes N that are required may be pre-set (e.g. stored in memory 20). Alternatively, the number of passes N may be dependent on the maximum pixel colour density of the image to be printed and/or the maximum number of sub-droplets ejectable by each nozzle in a particular nozzle ejection or the required image resolution/quality. For example, if the maximum pixel colour density is 10 sub-droplets, and each nozzle is configured to eject 5 sub-droplets in a particular ejection, the processor may be configured to determine that a minimum of two passes of the droplet deposition head 22 are required to build up a dot formed from 10 sub-droplets. In another example, if the maximum pixel colour density is 10 sub-droplets, and each nozzle is configured to eject 3 sub-droplets in a particular firing, the processor may be configured to determine that at least four passes of the droplet deposition head 22 will be required to build up a dot formed from 10 sub-droplets. In the case of a faulty nozzle, the faulty nozzle sub-droplets may be divided between one or more neighbouring nozzles and across two or more passes.

FIG. 5 shows a first mask 108*a* and a second mask 108*b* is generated for the subset of pixels, based on the mask values selected for each pixel. In this example, the first mask 108*a* may indicate how the nozzles (N1, N2, N3) are to eject fluid in the first pass of the droplet deposition head, and the second mask 108*b* may indicate how the nozzles are to eject fluid in the second pass of the droplet deposition head.

Figure 3:
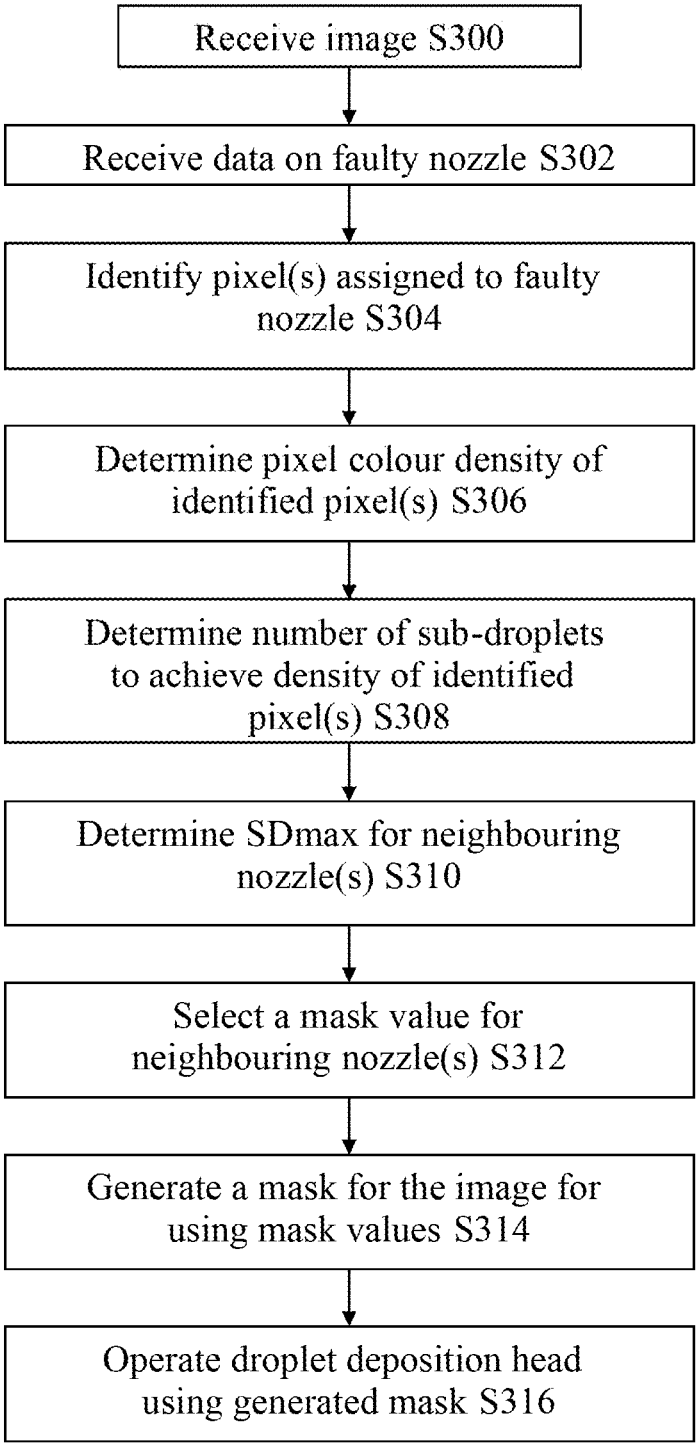
FIG. 3 shows a flow diagram of the general steps to operate a droplet deposition head having at least one faulty nozzle.

FIG. 3 shows a flow diagram of the general steps to operate a droplet deposition head having at least one faulty nozzle. A processor coupled to the droplet deposition head receives an image for printing (step S300), which may be a greyscale image. The processor may receive as an input a processed image which is to be printed, and to which a masking technique is to be applied. The processed image may be, for example, an image to which one or more image data transformations (such as colour correction, colour separation, linearization, half-toning, etc.) have been applied. The processor receives data indicating that at least one nozzle in a row of the nozzle array 30 is faulty (step S302), and is configured to identify each pixel of the image that is assigned to be printed by the faulty nozzle (step S304). This may enable the droplets required to form the pixel to be redistributed to one or more neighbouring nozzles adjacent to (or in the vicinity of) the faulty nozzle.

The processor determines a pixel colour density (G) for each pixel of the image (step S306), where G may be an integer value. The integer value of the pixel colour density indicates how many sub-droplets are required to form each pixel of the image on the receiving medium. The processor then determines a total number of sub-droplets required to provide the determined pixel colour density for each pixel (step S308). The processor determines the maximum number of sub-droplets $SD_{max}$ ejectable by at least one neighbouring nozzle located adjacent to the faulty nozzle (step S310). The value of $SD_{max}$ for each neighbouring nozzle may be used to ensure that, in the faulty nozzle droplet redistribution process, the neighbouring nozzle is not assigned more sub-droplets to print than it is capable of printing.

The processor selects a mask value for each pixel, for each neighbouring nozzle, from a lookup table (step S312) and uses these to generate (or populate) a two-dimensional mask for the whole image (or a swathe of the image) (step S314). Each generated mask indicates which nozzles are to eject fluid on each pass in order to provide the determined pixel colour density for each pixel. The processor may then generate a drive signal to operate the droplet deposition head based on the generated mask for the image (step S316).

Figure 4:
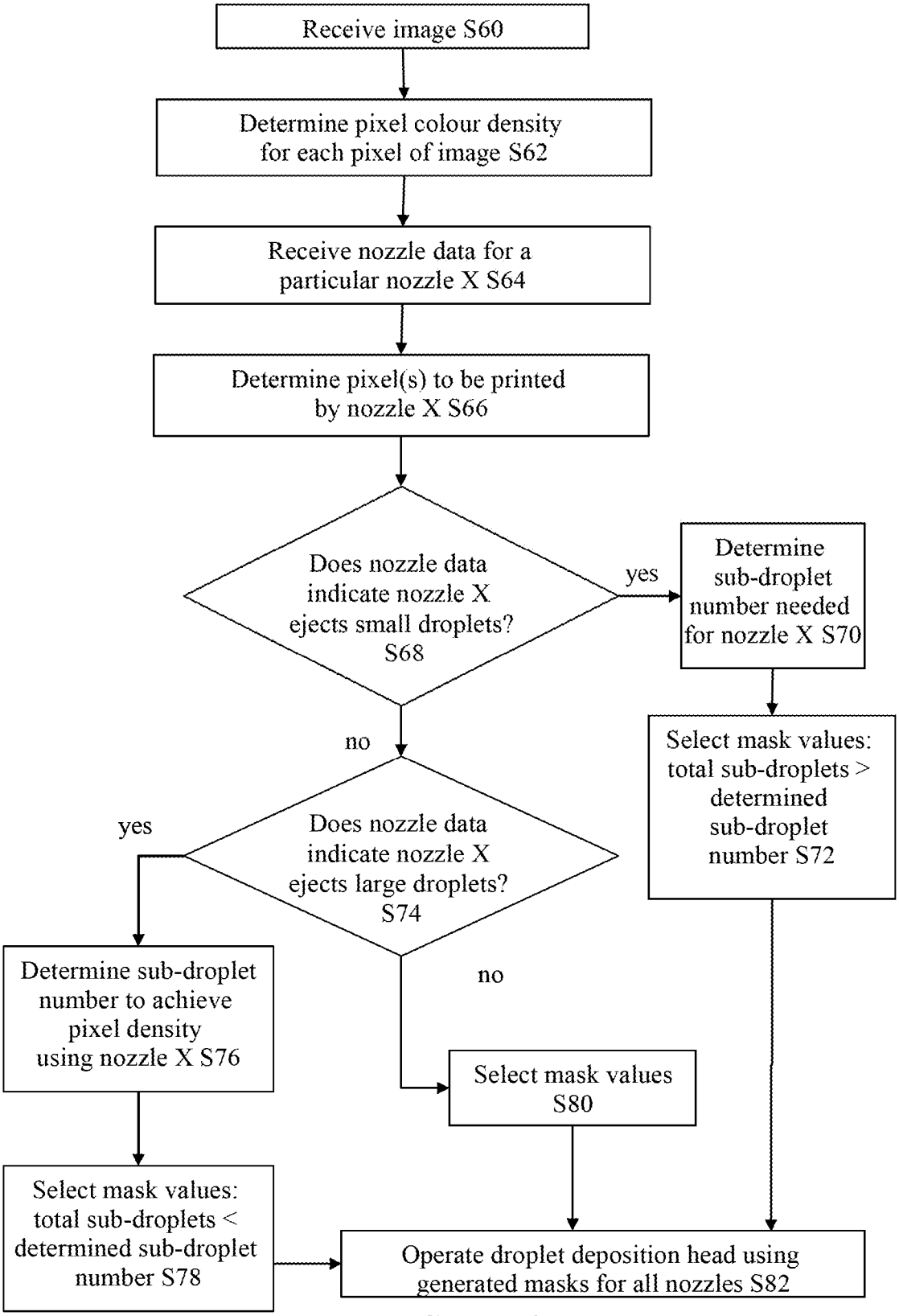
FIG. 4 shows a flow diagram of the steps to operate a droplet deposition head having a nozzle that ejects droplets of a particular size.

As mentioned above, although a nozzle array 30 is typically formed of multiple rows of identical nozzles which are designed to eject droplets of a particular, pre-defined size, some nozzles may (due to, for example, manufacturing tolerances, processing variations, or prolonged usage), eject droplets which are smaller or bigger than the pre-defined droplet size. If these nozzles are identifiable, it may be possible to compensate for these nozzles in the masks generated by the processor 16. Such a nozzle may be a neighbouring nozzle adjacent to a faulty nozzle. FIG. 4 shows a flow diagram of the steps to operate a droplet deposition head having a nozzle that ejects droplets of a particular size, which may be smaller than, equal to, or greater than the pre-defined droplet size. Broadly speaking, the at least one processor of the apparatus is configured to: select a mask value for each pixel for each of the N passes such that the total number of sub-droplets specified by the selected mask values provides a pixel colour density for each pixel that is a function of the determined pixel colour density of the pixel.

However, if one or more of the nozzles of the nozzle array(s) is identified as ejecting droplets that are smaller or bigger than the pre-defined droplet size, the general steps to generate a mask outlined in FIG. 3 are altered. A nozzle which ejects droplets that are smaller or bigger than the pre-defined droplet size is termed an 'erroneous nozzle' herein. The term 'erroneous nozzle' is used herein to mean a nozzle which, for some reason (e.g. manufacturing tolerances or processing variations), ejects sub-droplets which are either smaller than or greater than the pre-defined sub-droplet size. The erroneous nozzle may not differ in any other way from correctly-functioning nozzles (which eject sub-droplets of the pre-defined size) of a nozzle array. For example, the erroneous nozzle may have the same physical dimensions/physical features as a correctly-functioning nozzle. The erroneous nozzle may be the neighbouring nozzle (or one or more of the neighbouring nozzles) selected to deposit the faulty nozzle sub-droplets. Thus, if a neighbouring nozzle is selected to deposit the faulty nozzle sub-droplets, the process shown in FIG. 4 may be performed to compensate for the erroneous nozzle.

Accordingly, as shown in FIG. 4, the process to generate masks and operate a droplet deposition head begins by receiving an image (step S60) and determine the pixel colour density for each pixel of the image (step S62). The received image may be a processed image, e.g. an image to which one or more image data transformations (such as colour correction, colour separation, linearization, half-toning, etc.) have been applied. The processor may then receive nozzle data for a particular erroneous nozzle X (step S64). If nozzle X was known to be defective during the manufacture of the apparatus 26, the nozzle data may be stored in the data store 18 of the apparatus 26, and the processor may simply be configured to retrieve the nozzle data from the data store when a mask is to be generated. The processor may then determine which pixel (or pixels) of the image is to be printed by the defective nozzle X (step S66), so that the masks compensate for the defective nozzle in the appropriate location(s) with the mask arrays.

The processor 16 may be configured to determine if the nozzle data indicates that erroneous nozzle X ejects droplets which are smaller than the pre-defined droplet size (step S68). If nozzle X does eject droplets that are smaller than the pre-defined droplet size, the processor is configured to determine how many sub-droplets need to be ejected by erroneous nozzle X to provide a particular pixel colour density (step S70). For example, if the pixel colour density is 3 (indicating that three sub-droplets are need to provide a dot with this pixel colour density), erroneous nozzle X may need to eject four sub-droplets to achieve the required pixel colour density. The nozzle data may include information on how much smaller the droplets ejected by nozzle X are relative to the pre-defined droplet size, which may be used to determine how many sub-droplets nozzle X needs to eject for a particular pixel colour density value. The processor 16 may then select a mask value for the or each pixel to be printed by the 'erroneous' nozzle, for each of the N passes, by selecting a mask value for each of the N passes, such that the total number of sub-droplets specified by the selected mask values is greater than the determined total number of sub-droplets and results in a pixel colour density which is a function of the determined pixel colour density (step S72). The processor uses the selected mask values to generate the mask for each of the N passes for only those pixels to be printed by the undersized nozzle X. The resulting pixel colour density (or the printed dot) may be, for example, substantially equal, or equal to, the determined pixel colour density. The resulting pixel colour density may vary from the determined pixel colour density by a particular amount/percentage which is acceptable, such that it does not give rise to any substantial or significant image quality problems or defects.

If at step S68 it is determined that nozzle X does not eject small droplets, the processor then determines whether the nozzle data indicates erroneous nozzle X ejects droplets which are larger than the pre-defined droplet size (step S74). If the processor 16 determines that the nozzle data does not indicate that nozzle X ejects larger droplets, it determines that nozzle X ejects droplets which are substantially similar to the pre-defined droplet size and selects mask values in the above-described way (step S80). However, if the nozzle data does indicate that erroneous nozzle X ejects larger droplets, the processor is configured to determine how many sub-droplets need to be ejected by erroneous nozzle X to provide a particular pixel colour density (step S76). For example, if the pixel colour density is 3 (indicating that three sub-droplets are need to provide a dot with this pixel colour density), erroneous nozzle X may need to eject only two sub-droplets to achieve the required pixel colour density. The nozzle data may include information on how much larger the droplets ejected by erroneous nozzle X are relative to the pre-defined droplet size, which may be used to determine how many sub-droplets nozzle X needs to eject for a particular pixel colour density value. The processor 16 may then select a mask value for the or each pixel to be printed by the erroneous nozzle X, for each of the N passes, by selecting a mask value for each of the N passes, such that the total number of sub-droplets specified by the selected mask values is less than the determined total number of sub-droplets and results in a pixel colour density which is a function of the determined pixel colour density (step S78). The processor uses the selected mask values to generate the mask for each of the N passes for only those pixels to be printed by the oversized nozzle X. The resulting pixel colour density (of the printed dot) may be, for example, substantially equal, or equal to, the determined pixel colour density. The resulting pixel colour density may vary from the determined pixel colour density by a particular amount/percentage which is acceptable, such that it does not give rise to any substantial or significant image quality problems or defects.

In each scenario, once mask values have been determined for the pixel(s) to be printed by nozzle X, the processor 16 generates a mask for the whole image (and all nozzles), as described above, and operates the droplet deposition head using the generated masks (step S82).

Figure 6:
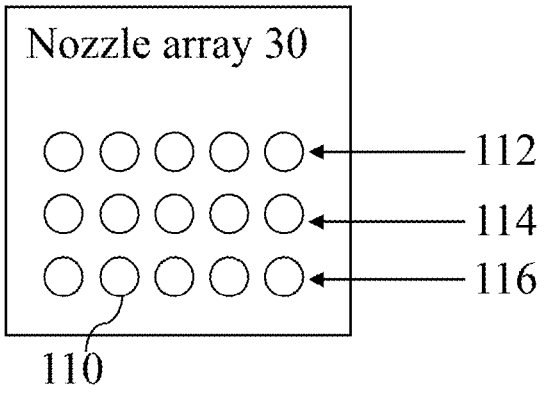
FIG. 6 shows a schematic diagram of nozzle arrays.
Figure 6:
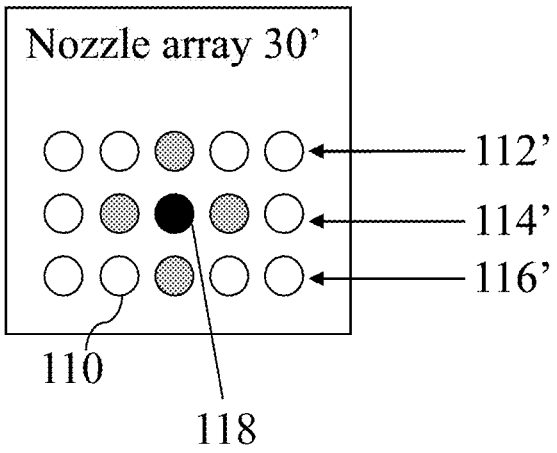

FIG. 6 shows a schematic diagram of nozzle arrays. The example nozzle array 30 depicted here comprises three rows of five nozzles each. Specifically, the nozzle array 30 comprises a first row 112 comprising five nozzles 110 (indicated by the circles), a second row 114 comprising five nozzles 110, and a third row 116 comprising five nozzles. Nozzle array 30' also comprises a first row 112' comprising five nozzles 110 (indicated by the circles), a second row 114' comprising five nozzles 110, and a third row 116' comprising five nozzles. however, in nozzle array 30', one of the nozzles is a faulty nozzle. Specifically, nozzle 118 (represented by a black circle) is a faulty nozzle. As described above, all of the nozzles of nozzle array 30' are assigned to print one or more pixels of an image, including the faulty nozzle 118. However, as using the faulty nozzle 118 would result in image defects, the sub-droplets required to print its assigned pixel (s) are redistributed to one or more neighbouring nozzle. For example, the faulty nozzle sub-droplets could be assigned to a neighbouring nozzle in the same row as the faulty nozzle, i.e. in row 114'. The grey circles in row 114' represent potential neighbouring nozzles which could be used to compensate for the faulty nozzle. In another embodiment, the faulty nozzle sub-droplets could be assigned to an adjacent nozzle in one or both of the row above the faulty nozzle (row 112') and the row below the faulty nozzle (row 116'), as shown by the grey circles. In another arrangement, the faulty nozzle sub-droplets could be assigned to one or more nozzles in rows 112' and/or 114' that are diagonally adjacent to the faulty nozzle 118.

If a neighbouring nozzle selected to deposit the faulty nozzle sub-droplets (or part of the faulty nozzle sub-droplets) is unable to deposit these additional sub-droplets, the remaining sub-droplets are distributed to one or more nozzles, which may not be directly adjacent to the faulty nozzle. In this way, the faulty nozzle sub-droplets may be distributed across multiple nozzles which are not necessarily all immediately adjacent the faulty nozzle 118.

Lookup Table Generation

Figure 7:
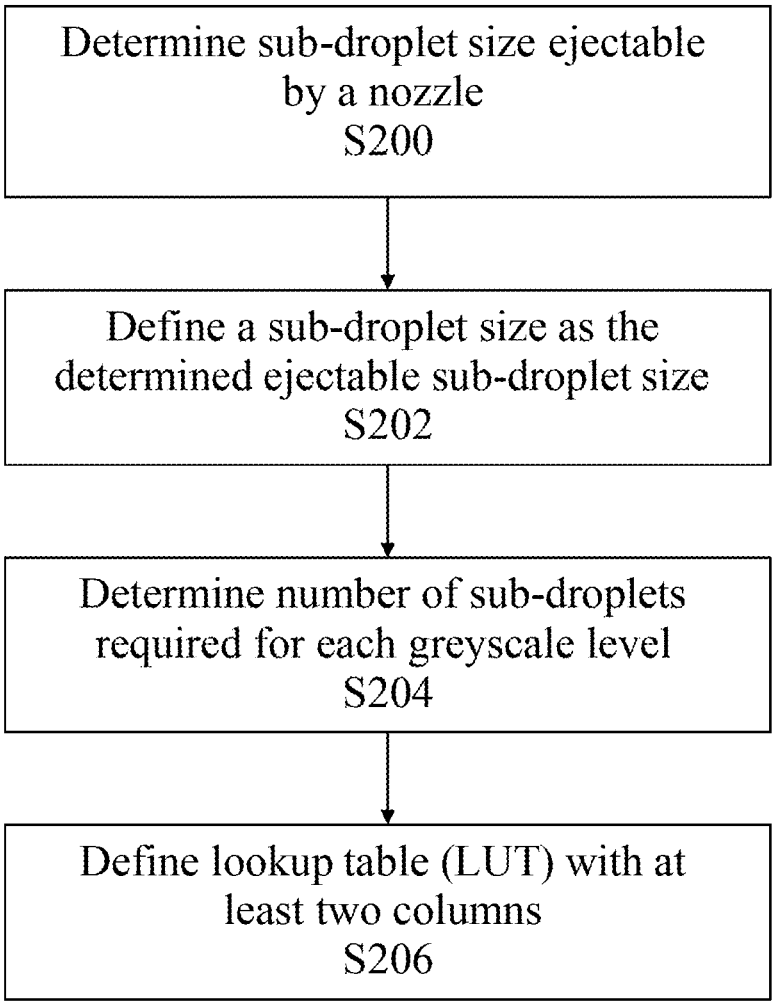
FIG. 7 is a flow diagram of the steps to define a lookup table for a masking technique.

FIG. 7 is a flow diagram of the steps to define a lookup table for a masking technique. As explained earlier, the lookup tables used to generate the masks used in the masking techniques described herein are preferably generated by a manufacturer of the droplet deposition device (e.g. apparatus 26), and are configurable to suit the specific characteristics and technical specifications of the device. An example technique to define a lookup table is now described. A manufacturer determines a sub-droplet size that is ejectable by each nozzle of the apparatus (step S200). This may be determined by performing some calibration or testing of the nozzles, or may be determined from information obtained from the nozzle (or droplet deposition head) supplier/designer. Once known, it is possible to define (pre-define) a particular sub-droplet size (step S202). This may be, for example, the mean sub-droplet size ejectable by the nozzles of the apparatus, or some other average value (e.g. the median or the mode). This pre-defined sub-droplet size is used to determine if any of the nozzles are ejecting small or large sub-droplets, and to compensate for this, as described above. The apparatus manufacturer may then determine the number of sub-droplets of the pre-defined sub-droplet size which, for this particular apparatus, are required to produce each greyscale level (step S204). For example, a particular shade of grey, having a particular pixel colour density G, may require 3 sub-droplets of the pre-defined sub-droplet size to produce a dot of that shade. The pixel colour density or sub-droplet value for each greyscale level (G) may be an integer value. The integer value of the pixel colour density may indicate how many sub-droplets are required to form each pixel of the image on the print medium. Typically, the number of sub-droplets required increases with G, that is, a darker shade of grey will require more sub-droplets to produce a dot of that shade than a lighter shade of grey. The grayscale values G are the input to the rows of the lookup table (LUT), and potential mask values M are the input to the columns of the lookup table. Thus, the manufacturer defines a LUT having at least two columns (step S206).

FIG. 8 shows example lookup tables for a masking technique. Lookup table (LUT) 170 is a two-dimensional table/array having the G values 174 as input to the rows of the LUT and mask values M 172 as input to the columns. Although table 170 illustrated here has six columns, there is no limit on the number of columns that can be used.

Similarly, the LUT 170 may have as many rows as needed to cover each of the possible greyscale levels. The mask values are preferably configurable by the manufacturer of the apparatus 26 to suit the technical specifications of the apparatus. For example, to produce a G value of 3, the possible mask values may vary from 0 (indicating 0 sub-droplets are to be printed by a nozzle during a particular pass, or from a particular nozzle array), all the way up to a mask value of 3 (indicating 3 sub-droplets are to be printed by a nozzle). During mask generation, the processor 16 of the apparatus 26 may select a mask value for each pixel, and for each pass or nozzle array, such that the total number of sub-droplets required to produce a dot of a particular grey-scale level is provided once all masks have been applied (i.e. to all N passes, or to two nozzle arrays), as described above. The choice of mask values selected for each nozzle may depend on factors such as whether a neighbouring nozzle is to eject fluid in the same pass/same nozzle array, or if the nozzle cannot eject fluid more than a particular number of sub-droplets in one round of nozzle firings/ejections. Accordingly, it may be useful to include a wide variety of mask values (and mask value columns M) in each LUT to increase the choice of mask values available to the processor 16 when generating a mask for a particular image.

For example, the nozzles of the apparatus may be configured to eject a pre-defined maximum number of sub-droplets per nozzle ejection (actuation). In this case, the processor 16 may be configured to receive (e.g. from the data store 18) data specifying the pre-defined maximum number of sub-droplets ejectable by each nozzle. The processor 16 may then filter out any mask values from the lookup table (e.g. LUT 170) which specify a sub-droplet value that exceeds the pre-defined maximum number of sub-droplets, and select a mask value from the filtered lookup table, for each nozzle, each mask value specifying zero or more sub-droplets to be printed for each pixel of the image. The pre-defined maximum number may be uniform across all the nozzles of the apparatus, or may vary between nozzles, or between the nozzles of different nozzle arrays. For example, if the pre-defined maximum number of sub-droplets is 2, then the processor 16 may filter out the mask value '3' which appears in LUT 170 in the bottom row. In this example, if the apparatus 26 operated in a two-pass mode, a nozzle would have to eject 1 sub-droplet in one pass and 2 sub-droplets in another pass in order to achieve a G value of 3, since the nozzles are incapable of ejecting all three sub-droplets in one ejection/pass.

Additionally or alternatively, the LUT configured by the apparatus manufacturer may take into account the pre-defined maximum number of sub-droplets ejectable by each nozzle, such that the processor 16 does not need to perform the above-mentioned filtering. This may mean that the amount of processing required by processor 16 to generate masks is reduced, which may make the mask generation and printing processes more efficient, faster and less power-consuming than if the filtering step is required.

A possible condition for an LUT (e.g. LUT 170) to be correct for a two-pass masking technique is that, for any given column c in the LUT, there is another column k such that $$L_{r,c}+L_{r,k}=G_r\forall_r$$

where $\forall_r$ means "for all values of r". This condition assumes that the intent is always to eject the same amount of total fluid. In the example LUT 170 shown in FIG. 8, columns 0 and 1 add up to G, as do columns 2 and 3, as do columns 4 and 5. This enables the processor 16 to choose, for each pixel of the image, between three sets of divisions of sub-droplets between the two passes of the droplet deposition head 22. If, for example, the mask M for the first pass for a given pixel has a value of 2 (i.e. it will map {0, 1, 2, 3} to {0, 0, 1, 1} for this pixel), the mask M for the second pass should have a value of 3 (i.e. it will map {0, 1, 2, 3} to {0, 1, 1, 2} for this pixel), as this ensures that for any pixel colour density of that pixel, two masks M have been specified that will provide the required number of sub-droplets to produce that pixel colour density. For example, if the pixel colour density (G) of this pixel is '3', then the processor 16 will pick the relevant mask value from each mask M to provide a total number of three sub-droplets across the masks, i.e. a mask value of '1' from the first mask and a mask value of '2' from the second mask.

It may be beneficial to have a column set that spreads the drops as evenly as possible. The number of columns in the LUT (and therefore, the range of mask values) is only limited by the capabilities of the system. Generally speaking, the number of columns is preferably a multiple of the number of passes p. If, for example, p=3 then the LUT may be as follows:

| | 0 | 1 | 2 | 3 | 4 | 5 | M |
|---|---|---|---|---|---|---|---|
| 0 | 0 | 0 | 0 | 0 | 0 | 0 | |
| 1 | 0 | 1 | 0 | 1 | 0 | 0 | |
| 2 | 0 | 1 | 1 | 1 | 0 | 1 | |
| 3 | 0 | 2 | 1 | 1 | 2 | 0 | |
| G | | | | | | | |

In this case the masks M having values 0, 1, and 2 together add up to G (i.e., they are complementary), as are columns 3, 4 and 5.

It is possible to have sets of columns that add up to more than, or less than, G. This may be beneficial, for example, if some nozzles of an apparatus 26 are known to eject sub-droplets of a different size to the majority of the nozzles, as mentioned above. An example two-pass LUT 176 that compensates for an 'undersized' nozzle (i.e. a nozzle which ejects sub-droplets that are smaller than a pre-defined sub-droplet size) is shown in FIG. 8. The processor 16 may select columns 4 and 5 for the undersized nozzle, as the total number of sub-droplets specified by this pair of columns is greater than the determined total number of sub-droplets needed for a particular pixel, and results in a dot density at least equal to the determined pixel colour density (G), as described earlier.

No doubt many other effective alternatives will occur to the skilled person. For example, it will be understood that whilst various concepts are described above with reference to an inkjet printhead, such concepts are not limited to inkjet printheads, but may be applied more broadly in printheads, or more broadly still in droplet deposition heads, for any suitable application. As noted above, droplet deposition heads suitable for such alternative applications may be generally similar in construction to printheads, with some adaptations made to handle the specific fluid in question. The preceding description should therefore be understood as providing non-limiting examples of applications in which such a droplet deposition head may be used. Furthermore, the invention is not limited to the described embodiments and encompasses modifications apparent to those skilled in the art lying within the spirit and scope of the claims appended hereto.

The invention claimed is:

1. A droplet deposition apparatus comprising:

at least one droplet deposition head having a plurality of nozzles arranged in at least one row, the droplet deposition head configured to print an image;

an interface for receiving a half-toned image to be printed, the image comprising a plurality of pixels; and at least one processor configured to:

receive data indicating that a nozzle in a row is faulty;

identify each pixel of the image that is assigned to be printed by the faulty nozzle;

determine a pixel color density for each identified pixel;

determine a total number of sub-droplets required to provide the determined pixel color density for each identified pixel;

determine the maximum number of sub-droplets SDmax ejectable by at least one neighboring nozzle located in the vicinity of the faulty nozzle;

select, using a lookup table, a mask value for the neighboring nozzle, each mask value specifying zero or more sub-droplets to be printed for each identified pixel by the neighboring nozzle instead of the faulty nozzle, wherein the mask value for each identified pixel is less than or equal to the maximum number of sub-droplets SDmax of the neighboring nozzle;

generate a mask for the image comprising the selected mask values for the neighboring nozzle; and operate the droplet deposition head to eject zero or more sub-droplets from the neighboring nozzle according to the generated mask, such that the determined pixel color density for each identified pixel assigned to the faulty nozzle is provided by the at least one neighboring nozzle, wherein:

the droplet deposition apparatus further comprises at least a first row of nozzles, a second row of nozzles located below the first row, and a third row of nozzles located below the second row;

the faulty nozzle is located in the second row and is incapable of ejecting fluid; and the at least one processor is further configured to:

determine a maximum number of sub-droplets SDmax ejectable by a first neighboring nozzle located in the vicinity of the faulty nozzle in the first row, and a second neighboring nozzle located in the vicinity of the faulty nozzle in the third row; and select, using the lookup table, a mask value for each of the first and second neighboring nozzles, each mask value specifying zero or more sub-droplets to be printed for each identified pixel by each of the first and second neighboring nozzles, wherein the mask values for each identified pixel are selected is less than or equal to the maximum number of sub-droplets SDmax of the first and second neighboring nozzles.

2. The droplet deposition apparatus as claimed in claim 1 comprising one row of nozzles, wherein the neighboring nozzle is located adjacent to the faulty nozzle in the row.

3. The droplet deposition apparatus as claimed in claim 1 comprising at least a first row of nozzles and a second row of nozzles, wherein the faulty nozzle is located in the first row and wherein the neighboring nozzle is located in the vicinity of the faulty nozzle in any one of: the first row and the second row.

4. The droplet deposition apparatus as claimed in claim 1 wherein the processor is configured to:

check that the total number of sub-droplets required to provide the determined pixel color density for each identified pixel can be assigned to the or each neighboring nozzle without exceeding the maximum number of sub-droplets SDmax of each neighboring nozzle.

5. The droplet deposition apparatus as claimed in claim 4 wherein, if the processor determines the maximum number of sub-droplets SDmax of the or each neighboring nozzle will be exceeded, the processor is configured to:

determine a number of remaining sub-droplets for the faulty nozzle which have not been allocated to the or each neighboring nozzle;

determine at least one further nozzle capable of ejecting at least part of the remaining sub-droplets; and select a mask for the at least one further nozzle, the mask specifying one or more sub-droplets to be printed for the pixel.

6. The droplet deposition apparatus as claimed in claim 1 further comprising a fault detection means configured to detect a fault in the nozzles wherein the at least one processor is configured to receive data indicating that nozzle is faulty from the fault detection means.

7. The droplet deposition apparatus as claimed in claim 1 wherein further comprising a data store configured to store calibration data identifying at least one faulty nozzle of the droplet deposition head.

8. The droplet deposition apparatus as claimed in claim 7 wherein the data store is configured to store data identifying at least one predetermined neighboring nozzle to be used to deposit fluid instead of each faulty nozzle, wherein the predetermined neighboring nozzle is located in any one or more of: a row containing the faulty nozzle, a row above the row containing the faulty nozzle, and a row below the row containing the faulty nozzle.

9. The droplet deposition apparatus as claimed in claim 1 wherein the at least one processor is configured to:

determine an average number of sub-droplets ejected by each nozzle of the droplet deposition head;

identify one or more nozzles that are configured to eject a number of sub-droplets greater than the average number of sub-droplets;

identify one or more nozzles that are configured to eject a number of sub-droplets less than the average number of sub-droplets; and select, using the lookup table, a mask value for each nozzle of the droplet deposition head to perform load-balancing across the nozzles.

10. The droplet deposition apparatus as claimed in claim 1 wherein the lookup table is a two-dimensional array having at least two columns, each column containing mask values for a varying pixel color density, and wherein the at least one processor is configured to:

select mask values for each identified pixel by selecting a value from one of the at least two columns dependent on the determined total number of sub-droplets.

11. The droplet deposition apparatus as claimed in claim 1, wherein the at least one processor is configured to:

select a mask value for the or each neighboring nozzle such that the total number of sub-droplets specified by the selected mask values provides a pixel color density for each pixel that is a function of the determined pixel color density of the pixel.

12. The droplet deposition apparatus as claimed in claim 1 wherein the plurality of nozzles are operated by at least one actuator element, the apparatus further comprising a drive waveform generator configured to:

receive the generated mask for the image;

generate a drive waveform for each nozzle dependent on the received mask; and transmit the generated drive waveforms to the at least one actuator element to operate the nozzles.

13. The droplet deposition apparatus as claimed in claim 1 wherein a set of nozzles are operated by at least one actuator element using a common drive signal, and wherein the apparatus further comprises a drive waveform generator configured to:

receive the generated mask for the image;

modify the common drive signal provided to the set of nozzles of each nozzle array dependent on the received masks; and transmit the modified common drive signal to the at least one actuator to operate the set of nozzles.

14. The droplet deposition apparatus as claimed in claim 1 wherein the or each neighboring nozzle of the droplet deposition head is configured to eject a pre-defined maximum number of sub-droplets.

15. The droplet deposition apparatus as claimed in claim 14 wherein the at least one processor is configured to:

receive the pre-defined maximum number of sub-droplets ejectable by each neighboring nozzle;

filter out any mask values from the lookup table which specify a sub-droplet value that exceeds the pre-defined maximum number of sub-droplets for each identified pixel;

and select a mask value from the filtered lookup table, for each neighboring nozzle, each mask value specifying zero or more sub-droplets to be printed for each identified pixel by the neighboring nozzle instead of the faulty nozzle.

16. A method for printing an image, the method comprising:

receiving, a half-toned image to be printed, the image comprising a plurality of pixels;

receiving data indicating that a nozzle in a row of nozzles within a droplet deposition head is faulty;

identifying each pixel of the image that is assigned to be printed by the faulty nozzle;

determining a pixel color density for each identified pixel;

determining a total number of sub-droplets required to provide the determined pixel color density for each identified pixel;

determining the maximum number of sub-droplets SDmax ejectable by at least one neighboring nozzle located in the vicinity of the faulty nozzle;

selecting, using a lookup table, a mask value for the at least one neighboring nozzle, each mask value specifying zero or more sub-droplets to be printed for each identified pixel by the neighboring nozzle instead of the faulty nozzle, wherein the mask value for each identified pixel is less than or equal to the maximum number of sub-droplets SDmax of the neighboring nozzle; and generating a mask for the image comprising the selected mask values for the neighboring nozzle, wherein:

the droplet deposition head comprises at least a first row of nozzles, a second row of nozzles located below the first row, and a third row of nozzles located below the second row;

the faulty nozzle is located in the second row and is incapable of ejecting fluid;

determining the maximum number of sub-droplets SDmax ejectable by at least one neighboring nozzle comprises determining a maximum number of sub-droplets SDmax ejectable by a first neighboring nozzle located in the vicinity of the faulty nozzle in the first row, and a second neighboring nozzle located in the vicinity of the faulty nozzle in the third row; and selecting the mask value for the at least one neighboring nozzle comprises selecting, using the lookup table, a mask value for each of the first and second neighboring nozzles, each mask value specifying zero or more sub-droplets to be printed for each identified pixel by each of the first and second neighboring nozzles, wherein the mask values for each identified pixel are selected is less than or equal to the maximum number of sub-droplets SDmax of the first and second neighboring nozzles.

17. The method as claimed in claim 16 further comprising:

operating the neighboring nozzle to eject zero or more sub-droplets according to the generated mask, such that the determined pixel color density for each identified pixel assigned to the faulty nozzle is provided by the at least one neighboring nozzle.

18. Circuitry comprising:

an interface for:

receiving a half-toned image comprising a plurality of pixels, and receiving data indicating that a nozzle in a row of nozzles within a droplet deposition head is faulty;

wherein the circuitry is configured to:

identify each pixel of the received image that is assigned to be printed by the faulty nozzle;

determine a pixel colour color density for each identified pixel;

determine a total number of sub-droplets required to provide the determined pixel color density for each identified pixel;

determine the maximum number of sub-droplets SDmax ejectable by at least one neighboring nozzle located in the vicinity of the faulty nozzle;

select, using a lookup table, a mask value for the neighboring nozzle, each mask value specifying zero or more sub-droplets to be printed for each identified pixel by the neighboring nozzle instead of the faulty nozzle, wherein the mask value for each identified pixel is less than or equal to the maximum number of sub-droplets SDmax of the neighboring nozzle; and generate a mask for the image comprising the selected mask values for the neighboring nozzle, and wherein:

the droplet deposition head comprises at least a first row of nozzles, a second row of nozzles located below the first row, and a third row of nozzles located below the second row;

the faulty nozzle is located in the second row and is incapable of ejecting fluid; and the circuitry is further configured to:

determine a maximum number of sub-droplets SDmax ejectable by a first neighboring nozzle located in the vicinity of the faulty nozzle in the first row, and a second neighboring nozzle located in the vicinity of the faulty nozzle in the third row; and select, using the lookup table, a mask value for each of the first and second neighboring nozzles, each mask value specifying zero or more sub-droplets to be printed for each identified pixel by each of the first and second neighboring nozzles, wherein the mask values for each identified pixel are selected is less than or equal to the maximum number of sub-droplets SDmax of the first and second neighboring nozzles.

19. The circuitry as claimed in claim 18 further configured to:

operate the neighboring nozzle to eject zero or more sub-droplets according to the generated mask, such that the determined pixel color density for each identified pixel assigned to the faulty nozzle is provided by the at least one neighboring nozzle.

* * * * *